US009207582B1

(12) United States Patent
Alexandrovich et al.

(10) Patent No.: US 9,207,582 B1
(45) Date of Patent: Dec. 8, 2015

(54) REDUCING TONING SPACING SENSITIVITY

(71) Applicants: Peter Steven Alexandrovich, Rochester, NY (US); Patrick Maddock Lambert, Rochester, NY (US); Rodney Ray Bucks, Webster, NY (US); Michael Thomas Dobbertin, Honeoye, NY (US)

(72) Inventors: Peter Steven Alexandrovich, Rochester, NY (US); Patrick Maddock Lambert, Rochester, NY (US); Rodney Ray Bucks, Webster, NY (US); Michael Thomas Dobbertin, Honeoye, NY (US)

(73) Assignee: EASTMAN KODAK COMPANY, Rochester, NY (US)

( * ) Notice: Subject to any disclaimer, the term of this patent is extended or adjusted under 35 U.S.C. 154(b) by 0 days.

(21) Appl. No.: 14/495,966

(22) Filed: Sep. 25, 2014

(51) Int. Cl.
*G03G 15/09* (2006.01)

(52) U.S. Cl.
CPC ..... *G03G 15/0928* (2013.01); *G03G 15/09* (2013.01)

(58) Field of Classification Search
CPC ..... G03G 9/10; G03G 9/107; G03G 15/09; G03G 15/0928
USPC ..... 399/267; 430/122.1, 122.2, 122.3, 430/123.41
See application file for complete search history.

(56) References Cited

U.S. PATENT DOCUMENTS

| | | | | |
|---|---|---|---|---|
| 4,473,029 | A | 9/1984 | Fritz et al. | |
| 4,546,060 | A | 10/1985 | Miskinis | |
| 4,714,046 | A | 12/1987 | Steele et al. | |
| 4,935,326 | A | 6/1990 | Creatura et al. | |
| 4,937,166 | A | 6/1990 | Creatura et al. | |
| 5,002,846 | A | 3/1991 | Creatura et al. | |
| 5,083,166 | A | 1/1992 | Hill et al. | |
| 5,106,714 | A | 4/1992 | Saha et al. | |
| 5,466,552 | A | 11/1995 | Sato et al. | |
| 5,518,849 | A | 5/1996 | Sato et al. | |
| 5,595,850 | A | 1/1997 | Honjo et al. | |
| 6,232,026 | B1 * | 5/2001 | Lambert | 430/111.33 |
| 6,608,641 | B1 | 8/2003 | Alexandrovich et al. | |
| 6,617,089 | B2 | 9/2003 | Meyer et al. | |
| 6,677,098 | B2 | 1/2004 | Meyer et al. | |
| 7,120,379 | B2 | 10/2006 | Eck et al. | |
| 8,617,781 | B2 | 12/2013 | Kawauchi | |
| 2002/0168200 | A1 | 11/2002 | Stelter et al. | |
| 2005/0069350 | A1 * | 3/2005 | Eck et al. | 399/267 |
| 2006/0133870 | A1 | 6/2006 | Ng et al. | |
| 2010/0055601 | A1 * | 3/2010 | Sugiura et al. | 430/111.31 |
| 2011/0217643 | A1 * | 9/2011 | Ishizuka | 430/105 |
| 2013/0157185 | A1 * | 6/2013 | Sakashita et al. | 430/105 |
| 2013/0252165 | A1 * | 9/2013 | Anno et al. | 430/108.11 |

* cited by examiner

*Primary Examiner* — Sophia S Chen
(74) *Attorney, Agent, or Firm* — Raymond L. Owens

(57) ABSTRACT

A method for reducing toning spacing sensitivity in an electrophotographic process is disclosed. The method includes providing a rotating magnetic member within a conductive non-magnetic development sleeve; providing a developer to the non-magnetic development sleeve for use with the rotating magnetic member including: (i) composite magnetic particles comprising strontium ferrite and lithium ferrite phases and (ii) toner particles. The method further includes moving a charged receiving medium into a toner transfer relationship with the developer on the non-magnetic development sleeve so as to provide a developed image on the receiving medium with reduced toning spacing sensitivity.

15 Claims, 15 Drawing Sheets

REDUCING TONING SPACING SENSITIVITY

CROSS-REFERENCE TO RELATED APPLICATION

Reference is made to commonly-assigned U.S. patent application Ser. No. 14/495,950 filed Sep. 25, 2014, entitled "Reducing Toning Spacing Sensitivity" by Peter S. Alexandrovich et al, the disclosure of which is incorporated herein.

FIELD OF THE INVENTION

This invention pertains to the field of electrophotographic printing and particularly to two-component magnetic brush development processes and carrier materials wherein the toning spacing sensitivity in an electrophotographic process is reduced.

BACKGROUND OF THE INVENTION

Electrophotography is a useful process for printing images on a receiver (or "imaging substrate"), such as a piece or sheet of paper or another planar medium, plastic, glass, fabric, metal, or other objects as will be described below. In this process, an electrostatic latent image is formed on a photoreceptor by uniformly charging the photoreceptor and then discharging selected areas of the uniform charge to yield an electrostatic charge pattern corresponding to the desired image (a "latent image").

After the latent image is formed, charged toner particles are brought into the vicinity of the photoreceptor and are attracted to the latent image to develop the latent image into a visible image. Note that the visible image might not be readily visible to the naked eye depending on the composition of the toner particles.

After the latent image is developed into a visible image on the photoreceptor, a suitable receiver is brought into juxtaposition with the visible image. A suitable electric field is applied to transfer the toner particles of the visible image to the receiver to form the desired print image on the receiver. The imaging process is typically repeated many times with reusable photoreceptors. The photoreceptor is typically in the form of a drum or a roller, but can also be in the form of a belt. The receiver can also be an intermediate transfer member, from which the visible image is further transferred to the final receiver such as a piece of paper. Thermal transfer processes are also useful in the same manner.

The receiver is then removed from its operative association with the photoreceptor and subjected to heat or pressure to permanently fix ("fuse") the print image to the receiver. Plural print images, e.g., of separations of different colors, are overlaid on one receiver before fusing to form a multi-color print image on the receiver.

The present invention describes improvements to the development or toning process. Numerous methods of development of the latent electrostatic image with charged toner particles are available. Liquid development with insulating carrier fluids including suspended charged toner particles can be used, as can methods with dry toner particles. Common dry toning processes include both mono-component and two-component methods. Mono-component toning systems generally apply dry toner particles to a development roller by way of a foam roller, a doctor blade, or both; the development roller then presents the charged toner to the electrostatic latent image on the photoreceptor. Two-component toning systems typically include toner particles and oppositely charged magnetic carrier particles, the mixture of which is called a two-component developer, attracted to a magnetic brush toning apparatus which then supplies developer to the latent electrostatic image.

Two-component development processes utilizing magnetic brush toning assemblies are also commercially practiced in a variety of forms. What is defined herein as "conventional" two-component development devices utilize a type of magnetic brush roller including a conductive, non-magnetic rotating shell or sleeve with internal stationary magnets. The shell is typically roughened in some fashion to aid in developer transport including flutes or grooves or simple random textures. The magnets are positioned at appropriate places to attract developer from a feed auger or feed roller, and at a position in opposition to the photoreceptor to provide a development zone where the carrier particles are held back magnetically while toner particles are attracted to the latent electrostatic image on the photoreceptor. There can be a blade or skive between the feed auger or roller and the toning roller to regulate the mass area density of the toning nap, the portion of the magnetic brush where the brush is in contact with the photoreceptor surface. The magnet configuration in the region after the toning zone (in the direction of shell rotation) is such that the developer is not attracted to the roller and can fall back into a return auger or a mixing sump depending on the design of the apparatus. Fresh replenisher toner is added to the mixing sump or the feed roller where it can triboelectrically charge against the magnetic carrier particles though mechanical agitation. Three auger toning stations are also common.

The earliest copiers and printers with conventional two-component development processes used magnetic carrier particles of relatively high magnetic saturation moment (Ms) such as sponge iron or stainless steel. These materials have a very low degree of permanent magnetic character; they do not retain a magnetization after exposure to a magnetic field. They have low remanence magnetization (Mr), low magnetic coercivity (Hc) values, and are termed soft magnetic materials. These particles form long, stiff magnetic chains on the toning roller. The mean particle diameter of such materials was typically in the range of 100-250 microns. Controlled electrical conductivity of the developer was important to uniformly tone both large solid areas and lines or text information characterized by high fringe electric fields. The development gap, defined as the closest distance between the toning roller and the photoreceptor, was typically about 200 mil (about 5000 microns). Such methods have been termed "thick nap" development processes.

More recent electrophotographic hardware is characterized by the use of "thin nap" two-component development methods including stationary magnetic poles in the development roller. These processes typically use magnetically soft, ferrite based carrier materials, such as copper-zinc ferrite, manganese ferrite, manganese-magnesium-strontium ferrite, magnetite, and others. The mean diameter of the carrier particles is generally in the range of 20 to 100 microns. The saturation magnetic moment of these ferrites is lower than the materials used for thick nap development processes. The development spacing is generally in the range of 10 to 20 mil, or about 250 to 500 microns. Due to the soft magnetic nature of such carrier materials there is not a particle to particle magnetic interaction in the absence of an external field. The developers are thus free flowing powders in the mixing and transport portions of the development hardware, which generally include simple spiral auger devices. The free flowing nature of soft ferrite developer is advantageous in the avoidance of toner depletion related mixing uniformity artifacts on prints due to rapid mixing and tribocharging with replenisher toner.

U.S. Pat. No. 5,595,850 to Honjo et al. describes magnetically soft manganese-magnesium-strontium ferrite particle compositions and their use as carriers for the purpose of electrophotographic two-component development. Such carriers can also contain a resin coating. The assignee to this patent, Powdertech Co. Ltd. of Chiba-ken, Japan, currently supplies these materials to the electrophotographic copier and printer industry, marketed as the "EF" ferrite product line. Such materials are manufactured over a range of sizes, shapes and electrical conductivities. It is believed that this product line today represents the world's predominant magnetic carrier used in thin nap two-component electrophotographic processes.

Thin nap development processes are also practiced with rotating rather than stationary core magnets. A toning roller with rotating core magnets requires the use of magnetically hard carrier particles such that the alternating magnetic field due to the magnet core rotation causes flipping or jumping action of the developer. A magnetically hard material can retain its magnetization after exposure to a magnetic field; hard magnetic materials are also known as permanent magnetic materials. It has been observed in our laboratory that soft magnetic materials will flow for a short period of time on a toning roller with a rotating magnetic core, but will then start to aggregate into non-moving chains of developer which grow in the circumferential direction of the roller. This aggregation or "freezing" process results in a non-functional magnetic brush. A toning process with rotating core magnets in the magnetic brush roller and permanently magnetized hard magnetic carrier materials is termed small particle development (SPD). The developer on an SPD toning roller transports in response to both the rotation of the magnetic core and the rotation of the shell. The flow driven by the magnets is in the opposite direction to the rotation of the magnets; if the rotation of the magnets is for example clockwise, the developer appears to jump backwards in the counter-clockwise direction as attracted by each incoming pole of the rotating core magnets. The flow due to core magnet rotation alone can be enough to provide adequate development of toner. However in most applications of SPD development the shell is also rotated, typically in the direction of flow due to the core magnets which is typically co-current with the rotation of the photoreceptor, which means that the shell and its internal magnetic core are rotating in opposite directions. The observed developer motion is thus due to a combination of core driven and shell driven flow. SPD development has been practiced with both rotating and stationary toning shells. The development spacing is typically in the range of 10 to 20 mil, or 250 to 500 microns. Strontium ferrite based carrier particles in the size range of 15 to 30 microns median diameter have been used. In general, as typically practiced, SPD two-component carrier particles are smaller than conventional two-component carrier particles.

Commonly-assigned U.S. Pat. No. 4,473,029 to Fritz et al., the disclosure of which is incorporated herein by reference, describes particular embodiments of SPD toning. Saturation or magnetization of the carrier in a magnetic field that yields an induced moment of at least 25 emu/g is described as useful to reduce the attraction of carrier to the photoreceptor (also known as DPU for developer pick-up).

Commonly-assigned U.S. Pat. No. 4,546,060 to Miskinis et al., the disclosure of which is incorporated herein by reference, describes hard ferrite materials useful as carrier materials for two-component development processes utilizing rotating core magnets. A useful range of coercivity of greater than 300 gauss when magnetically saturated, and of induced moment of greater than 20 emu/g at an applied field of 1000 gauss is described. Magnetization of the carrier by exposing it to a high magnetic field prior to use in the electrophotographic development process is taught. The use of strontium ferrite as a carrier particle meeting these requirements is disclosed.

Commonly-assigned U.S. Pat. No. 5,083,166 to Hill et al., the disclosure of which is incorporated herein by reference, describes a low cost development system which uses the principles of SPD and has its own supply of toner with the entire development subsystem replaced when the toner is depleted. This development subsystem has an irregularly shaped stationary shell surrounding a rotatable magnetic core. The shell is shaped to move hard magnetic carrier through a path which provides a relatively long development zone as well as strong magnetic field strength as the developer moves away from the development zone to avoid DPU in the image. This development subsystem has been used commercially in a single-color electrophotographic printer.

Commonly-assigned U.S. Pat. No. 4,714,046 to Steele, et al., the disclosure of which is incorporated herein by reference, describes a magnetic brush applicator for use in an electrographic reproduction apparatus for applying a magnetic two-component developer to an imaging member including a cylindrical non-magnetic toning shell having a rotatably driven magnetic core positioned therein. The axis of rotation of the magnetic core is displaced from the sleeve axis, such displacement being toward a toning zone at which the applicator applies developer to the imaging member. As a result of the non-concentric arrangement between the toning shell and the magnetic core, the torque requirements for rotating the magnetic core are reduced, developer removal from the toning shell is facilitated, and less thermal energy is introduced into the developer during rotation of the magnetic core.

Eastman Kodak currently manufactures electrophotographic equipment utilizing strontium ferrite based developers, rotating magnetic core toning rollers, and a non-concentric arrangement of the magnetic core and sleeve axes. The NexPress color printer is such a product, and can be used to demonstrate the advantages of the present invention.

The SPD two-component development process including rotating core magnets and hard magnetic carrier materials has particular advantages over two-component conventional development processes utilizing stationary core magnets and soft magnetic carrier materials. The SPD toning zone is characterized by developer flipping and churning action. This enables development at very high speeds with a single toning roller. It is believed that the high rate of development is due to developer motion, resulting from the rotating core magnets, transporting net charged carrier particles that have given up some toner particles to the toning shell where they can become discharged and thus not provide an electrical field which opposes development. This motion also constantly provides fresh developer that has not been depleted of toner to the photoreceptor surface. The conductivity of the hard magnetic carrier can be increased to further enhance the rate of development. The fluidized nature in the toning zone leads to particularly smooth, non-grainy deposits of toner. Directionality effects are also reduced. SPD development is particularly capable of handling a wide range of toner particle sizes.

Both SPD and conventional two-component development processes deposit toner on the photoreceptor at a rate proportional to the electric field in the development zone. The strength of the electric field available to attract toner is determined by the potential difference between the latent image on the photoreceptor and the bias voltage applied to the toning shell, divided by the toning zone spacing or toning shell to photoreceptor distance. In most electrophotographic devices, including the Kodak NexPress, the imaging member which carries the photoreceptor and the toning shell are cylinders. Due to the achievable tolerances during their manufacture these components are not perfectly round. The term runout is used to describe how far out of round a cylinder might be; there are numerous specifically defined engineering runout metrics that can be used to describe out of round cylinders. Cylinders can have one lobe, or be egg shaped with two lobes, and the runout can be non-uniform over the length of the cylinder. Surface runout of the cylinder can also be caused by mounting the cylinder on gudgeons which are not perfectly round or do not have an axis of rotation that is perfectly centered in the gudgeon. As an illustration, simple peak to valley runout values of 1 mil are possible in either imaging member or toning shell cylinders, and the toning zone spacing can typically be 15 mil. The electric field for development is thus modulated by 1/15 or 6.7% due to each of these cylinders as they rotate through the toning zone; both cylinders contribute simultaneously to the variation of the development spacing. The resulting toner density is varied by this continuous changing of toning spacing, and typically can be modulated by about the same 6.7% due to each cylinder. The spatial period of such non-uniformity in the resulting toner image is thus dependent on the rotational speed of the rollers and their diameters. There is thus the need to reduce the spacing sensitivity of two-component development processes.

The nature of SPD developer bulk powder is quite cohesive due to the magnetic interaction between permanently magnetized carrier particles. This clumpy nature can lead to slower mixing with freshly replenished toner, which can lead to image non-uniformity defects known as depletion streaks when the job stream includes very high coverage documents causing a large amount of replenisher toner to be added over a short time. The cohesive nature of the SPD developer requires that special designs be used for transport and mixing of the material. Simple screw auger conveyor designs that work with soft magnetic developers are not suitable for the transport of permanently magnetized, magnetically hard SPD materials. Even with these special designs, the transport and mixing of SPD materials in the SPD development subsystem requires significant energy input. There is thus a need to reduce the bulk powder cohesiveness and accordingly increase the free flow ability of SPD developer materials to improve the mixing of carrier with toner.

U.S. Pat. No. 6,617,089 to Meyer et al. discloses an electrographic two-component dry developer composition where carrier particles include a soft magnetic material which has a coercivity of less than 300 gauss when magnetically saturated, a magnetic remanence of less than 20 emu/g when in an applied field of 1000 gauss, and a hard magnetic material with a coercivity of at least 300 gauss when magnetically saturated and an induced moment of at least 20 emu/g when in an applied field of 1000 gauss. The mixture of hard and soft carrier particles is disclosed to be a blend of separate particles. The particular usefulness of such a mixture in a development process with rotating core magnets is not described.

U.S. Pat. No. 6,677,098 to Meyer et al. discloses an electrographic two-component dry developer composition where carrier particles includes a soft magnetic material which has a coercivity of at least 300 gauss when magnetically saturated, exhibit a magnetic moment of less than 20 emu/g when in an applied field of 1000 gauss, and a hard magnetic material with a coercivity of at least 300 gauss when magnetically saturated and an induced moment of at least 20 emu/g when in an applied field of 1000 gauss. The mixture of hard and soft carrier particles is disclosed to be a blend of separate particles, as well as a composite of both types of materials in the same particle. The particular usefulness of such a mixture in a development process with rotating core magnets is not described.

Commonly-assigned U.S. Pat. No. 4,473,029 to Saha and Zeman, the disclosure of which is incorporated herein by reference, describes "interdispersed" two phase composite carrier particles comprising a soft magnetic spinel phase with the general formula of $MFe_2O_4$, and a hard magnetic magnetoplumbite phase of the general formula $R_xP_{1-x}Fe_{12}O_{19}$. M must be an element that forms a spinel ferrite phase; Zn, Cu, Ni and Mg are disclosed. Given the required general formula $MFe_2O_4$, the element M must have a valence state of +2, as do Zn, Cu, Ni and Mg. Lithium (Li) which has a valence state of +1 is not included within the general formula. The hard magnetic phase rare earth element R is selected from lanthanum, neodymium, praseodymium, samarium, europium, and mixtures thereof. The hard magnetic phase element P is selected from strontium, barium, calcium, lead and mixtures thereof. The use of two-component developers based on such composite materials in a development process based on a magnetic brush assembly with a rotating magnetic core, and particular advantages of such a process, are not disclosed.

Commonly-assigned U.S. Pat. No. 5,106,714 to Saha et al., the disclosure of which is incorporated herein by reference, describes "interdispersed" two phase composite carrier particles comprising a soft magnetic spinel phase with the general formula of $MFe_2O_4$, and a hard magnetic magnetoplumbite phase of the general formula $PO.6Fe_2O_3$. M must be an element that forms a spinel ferrite phase; Co, Mn, and Fe are disclosed. Given the required general formula $MFe_2O_4$, the element M must have a valence state of +2, as do Co, Mn, and Fe. Lithium (Li) which has a valence state of +1 is not included within the general formula. The hard magnetic phase element P is selected from strontium, barium, calcium, lead and mixtures thereof. The use of two-component developers based on such composite materials in a development process based on a magnetic brush assembly with a rotating magnetic core, and particular advantages of such a process, are not disclosed.

U.S. Pat. No. 5,466,552 to Sato et al. discloses soft magnetic carrier materials based on lithium ferrite with the general formula of $(Li_2O)_x(Fe_2O_3)_{1-x}$ wherein x is not more than 16.7 mole %. Based on said lithium ferrite, Sato et al. also discloses the substitution of 3 to 15 mole % of $Li_2O$ or $Fe_2O_3$ with at least one member selected from the group consisting of alkaline earth metal oxides. The alkaline earth metal oxide is disclosed to be MgO, CaO, SrO or BaO. The use of such materials in a toning process with a rotating core magnetic brush is not disclosed.

U.S. Pat. No. 5,518,849 to Sato et al. discloses soft magnetic carrier materials prepared from lithium oxide and ferric oxide (lithium ferrite). Specific ranges of resistance are realized, and desirable development characteristics are achieved on an electrophotographic printer. Toning processes with rotating magnetic cores elements are not disclosed, nor are carrier particles based on composite carriers within which are dispersed soft magnetic lithium ferrite phases and hard magnetic ferrite phases.

U.S. Pat. No. 5,518,849 to Hakata discloses spherical composite particles comprising magnetically hard particles, magnetically soft particles and a phenol resin as a binder. The use of two-component developers based on such materials in a development process based on a magnetic brush assembly with a rotating magnetic core, and particular advantages of such a process, are not disclosed.

U.S. Pat. No. 8,617,781 to Kawauchi discloses carrier core particles for an electrophotographic developer, the carrier core particles containing lithium, wherein the amount of lithium contained in the carrier core particles is 10 ppm to 400 ppm. The use of two-component developers based on such materials in a development process based on a magnetic brush assembly with a rotating magnetic core, and particular advantages of such a process, are not disclosed.

Hard magnetic materials from which to prepare carrier particles appropriate for use in an SPD rotating core development process include magnetoplumbite phase ferrites having the general formula $PO.6Fe_2O_3$ wherein P is selected from the group consisting of strontium, barium, calcium, lead, and mixtures thereof. Strontium is particularly useful. These materials are also called hexagonal ferrites. The magnetoplumbite ferrite crystal phase has uniaxial magnetic anisotropy in that the a and b crystallographic axes are paramagnetic, while the c crystallographic axis is ferrimagnetic. Details about the magnetic properties of such ferrite magnetic materials can be found in Ferro-Magnetic Materials, E. P. Wolfarth editor, Elsevier Science Publishers B. V., 1982 and Magnetism and Magnetic Materials, D. Jiles, Chapman and Hall, 1991. Powdertech Co. Ltd. Japan provides strontium ferrite grades known as FCS-150, FCS-200 and FCS-300 to Eastman Kodak Co. for use in the NexPress electrophotographic printer. These materials have volume average particle sizes of approximately 17, 21 microns and 30 microns, respectively. The manufacturing method results in approximately spheroidal particles with a rough texture due to the protrusion of the randomly oriented platelet shaped crystals. The c-axis is the direction perpendicular to the platelet. The crystals are on the order of less than one to a few microns in size, and appear to be uniformly or randomly oriented within a carrier particle as seen in a scanning electron micrograph. This random orientation of the permanently magnetic c-axes within each carrier particle results in some c-axes being magnetized more than others after exposure to the high magnetizing field used in the carrier manufacturing process, since the degree to which a given c-axis will be magnetized is proportional to the magnitude of the field it sees which is dependent on its orientation to that applied magnetizing field. Crystallites whose c-axis is aligned perpendicular to the magnetizing field will not become permanently magnetized. After the bulk carrier powder is subject to the magnetizing field, each particle will thus be a permanent magnet with a net north-south axis.

Soft magnetic powders useful as carrier materials for stationary core two component development processes include copper-zinc ferrite, manganese ferrite, manganese-magnesium-strontium ferrite, and lithium ferrite, among others. Powdertech Co. Ltd. Japan provides grades of manganese-magnesium-strontium ferrite known as EF-35 and EF-20, which have volume average particles sizes of approximately 35 microns and 20 microns, respectively. These particles have a surface which has both smooth and rough textured areas, the roughness due to protruding crystallites as seen in a scanning electron micrograph. Materials including EF ferrite, lithium ferrite, manganese ferrite and copper-zinc ferrite have a spinel crystal structure with cubic magnetic anisotropy. Cubic magnetic anisotropy results in an essentially uniform magnetization response to an applied magnetic field for a given crystallite whatever the angle of that crystallite to the field may be.

The carrier materials used commercially in both conventional and SPD two-component development processes typically have a resinous coating applied. A coating is used for a variety of purposes including controlling the rate and degree of triboelectric charging of the carrier with the toner, controlling that tribocharge with respect to environmental conditions such as temperature and humidity, preventing filming of toner ingredients onto the carrier surface, prolonging the useful life of the developer with regard to the triboelectric charging ability, and changing the effective conductivity of the carrier particle, among others. A wide variety of coating materials have been used commercially as carrier coatings, particularly useful have been silicones, acrylics and fluoropolymers. U.S. Pat. No. 4,935,326, U.S. Pat. No. 4,937,166, and U.S. Pat. No. 5,002,846, all to Creature and Hsu, describe blends of resins particularly useful as carrier coatings for two-component development processes.

However, none of the art discussed above successfully reduces the spacing sensitivity of two-component development processes using a magnetic brush assembly with a rotating magnetic core, while reducing bulk powder cohesiveness to increase the free flow ability of SPD developer materials and improve mixing of carrier with toner.

SUMMARY OF THE INVENTION

According to the present invention, there is provided a method for reducing toning spacing sensitivity in an electrophotographic process comprising:

(a) providing a rotating magnetic member within a conductive non-magnetic development sleeve;

(b) providing a developer to the non-magnetic development sleeve for use with the rotating magnetic member including:

(i) composite magnetic particles comprising strontium ferrite and lithium ferrite phases; and (ii) toner particles; and (c) moving a charged receiving medium into a toner transfer relationship with the developer on the non-magnetic development sleeve so as to provide a developed image on the receiving medium with reduced toning spacing sensitivity.

A feature of the present invention provides reduced two-component development spacing sensitivity in a rotating magnetic core SPD development system, by providing a composite magnetic material comprising lithium ferrite and strontium ferrite phases in the carrier component of the developer.

Another feature of the present invention provides reduced bulk powder cohesiveness to increase the free flow ability of SPD developer materials and improve mixing of carrier with toner by providing a composite magnetic material comprising lithium ferrite and strontium ferrite phases in the carrier component of the developer.

BRIEF DESCRIPTION OF THE DRAWINGS

The above and other objects, features, and advantages of the present invention will become more apparent when taken in conjunction with the following description and drawings wherein identical reference numerals have been used, where possible, to designate identical features that are common to the figures, and wherein.

Figure 1:
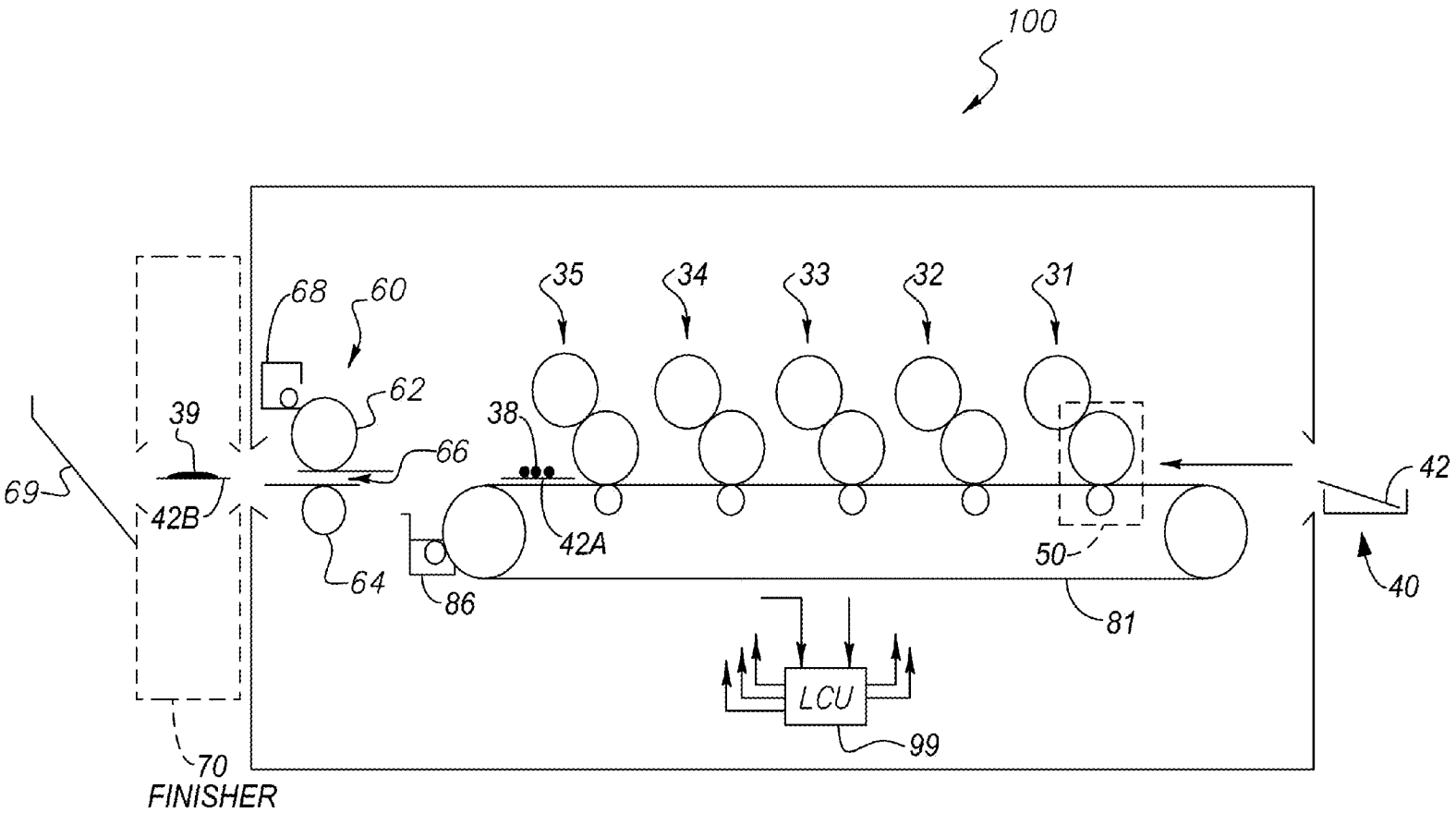
FIG. 1 is an elevational cross-section of an electrophotographic reproduction apparatus suitable for use with various embodiments.

The attached drawings are for purposes of illustration and are not necessarily to scale.

DETAILED DESCRIPTION OF THE INVENTION

As used herein, the terms "parallel" and "perpendicular" have a tolerance of ±10°. Further, when toner or carrier particle diameters are specified, these values represent the median diameters.

As used herein, "toner particles" are particles of one or more material(s) that are transferred by an electrophotographic (EP) printer to a receiver to produce a desired effect or structure (e.g., a print image, texture, pattern, or coating) on the receiver. Toner particles can be ground from larger solids, or chemically prepared (e.g., precipitated from a solution of a pigment and a dispersant using an organic solvent), as is known in the art. Toner particles can have a range of diameters, e.g., less than 8 μm, on the order of 10-15 μm, up to approximately 30 μm, or larger ("diameter" refers to the volume-weighted median diameter, as determined by a device such as a Coulter Multisizer).

"Toner" refers to a material or mixture that contains toner particles and that can form an image, pattern, or coating when deposited on an imaging member including a photoreceptor, a photoconductor, or an electrostatically-charged or magnetic surface. Toner can be transferred from the imaging member to a receiver. Toner is also referred to in the art as marking particles, dry ink, or developer, but note that herein "developer" is used differently, as described below. Toner can be a dry mixture of particles or a suspension of particles in a liquid toner base.

Toner includes toner particles and can include other particles. Any of the particles in toner can be of various types and have various properties. Such properties can include absorption of incident electromagnetic radiation (e.g., particles containing colorants such as dyes or pigments), absorption of moisture or gasses (e.g., desiccants or getters), suppression of bacterial growth (e.g., biocides, particularly useful in liquid-toner systems), adhesion to the receiver (e.g., binders), electrical conductivity or low magnetic reluctance (e.g., metal particles), electrical resistivity, texture, gloss, magnetic remanence, florescence, resistance to etchants, and other properties of additives known in the art. Toner particles themselves can be coated with even finer particles known as surface treatment agents. Such fine particles can be sub-micron to a few microns in size, and are added to enhance properties such as the free flow ability of the bulk toner powder and the toner triboelectric charging characteristics. Surface treatment agents in common use include pyrogenic silica, colloidal silica, titania, alumina, and fine resin particles, among others. The surface treatment agents themselves are commonly coated with compounds including a wide variety of types of silanes and silicones.

In single-component or mono-component development systems, "developer" refers to toner alone. In these systems, none, some, or all of the particles in the toner can themselves be magnetic. However, developer in a mono-component system does not include magnetic carrier particles. In dual-component, two-component, or multi-component development systems, "developer" refers to a mixture including toner particles and magnetic carrier particles, which can be electrically-conductive or non-conductive. Toner particles can be magnetic or non-magnetic. The carrier particles can be larger than the toner particles, e.g., 15-20 μm or 20-300 μm in diameter. A magnetic field is used to move the developer in these systems by exerting a force on the magnetic carrier particles. The developer is moved into proximity with an imaging member or transfer member by the magnetic field, and the toner or toner particles in the developer are transferred from the developer to the member by an electric field, as will be described further below. The magnetic carrier particles are not intentionally deposited on the imaging member by action of the electric field; only the toner is intentionally deposited. However, magnetic carrier particles, and other particles in the toner or developer, can be unintentionally transferred to an imaging member. Developer can include other additives known in the art, such as those listed above for toner. Toner and carrier particles can be substantially spherical or non-spherical.

The electrophotographic process can be embodied in devices including printers, copiers, scanners, and facsimiles, and analog or digital devices, all of which are referred to herein as "printers." Various embodiments described herein are useful with electrostatographic printers such as electrophotographic printers that employ toner developed on an electrophotographic receiver, and ionographic printers and copiers that do not rely upon an electrophotographic receiver. Electrophotography and ionography are types of electrostatography (printing using electrostatic fields), which is a subset of electrography (printing using electric fields).

A digital reproduction printing system ("printer") typically includes a digital front-end processor (DFE), a print engine (also referred to in the art as a "marking engine") for applying toner to the receiver, and one or more post-printing finishing system(s) (e.g., a UV coating system, a glosser system, or a laminator system). A printer can reproduce pleasing black-and-white or color images on a receiver. A printer can also produce selected patterns of toner on a receiver, which patterns (e.g., surface textures) do not correspond directly to a visible image. The DFE receives input electronic files (such as Postscript command files) composed of images from other input devices (e.g., a scanner, a digital camera). The DFE can include various function processors, e.g., a raster image processor (RIP), image positioning processor, image manipulation processor, color processor, or image storage processor. The DFE rasterizes input electronic files into image bitmaps for the print engine to print. In some embodiments, the DFE permits a human operator to set up parameters such as layout, font, color, paper type, or post-finishing options. The print engine takes the rasterized image bitmap from the DFE and renders the bitmap into a form that can control the printing process from the exposure device to transferring the print image onto the receiver. The finishing system applies features such as protection, glossing, or binding to the prints. The finishing system can be implemented as an integral component of a printer, or as a separate machine through which prints are fed after they are printed.

The printer can also include a color management system which captures the characteristics of the image printing process implemented in the print engine (e.g., the electrophotographic process) to provide known, consistent color reproduction characteristics. The color management system can also provide known color reproduction for different inputs (e.g., digital camera images or film images).

In an embodiment of an electrophotographic modular printing machine useful with various embodiments, e.g., the NEXPRESS SX3900 printer manufactured by Eastman Kodak Company of Rochester, N.Y., color-toner print images are made in a plurality of color imaging modules arranged in tandem, and the print images are successively electrostatically transferred to a receiver adhered to a transport web moving through the modules. Colored toners include colorants, e.g., dyes or pigments, which absorb specific wavelengths of visible light. Commercial machines of this type typically employ intermediate transfer members in the respective modules for transferring visible images from the photoreceptor and transferring print images to the receiver. In other electrophotographic printers, each visible image is directly transferred to a receiver to form the corresponding print image.

Electrophotographic printers having the capability to deposit clear toner using an additional imaging module are also known. The addition of a clear-toner overcoat to a color print is desirable for providing protection of the print from fingerprints and reducing certain visual artifacts. Clear toner uses particles that are similar to the toner particles of the color development subsystems but without colored material (e.g., dye or pigment) incorporated into the toner particles. However, a clear-toner overcoat can add cost and reduce color gamut of the print; thus, it is desirable to provide for operator/user selection to determine whether or not a clear-toner overcoat will be applied to the entire print. A uniform layer of clear toner can be provided. A layer that varies inversely according to heights of the toner stacks can also be used to establish level toner stack heights. The respective color toners are deposited one upon the other at respective locations on the receiver and the height of a respective color toner stack is the sum of the toner heights of each respective color. Uniform stack height provides the print with a more even or uniform gloss.

Figure 2:
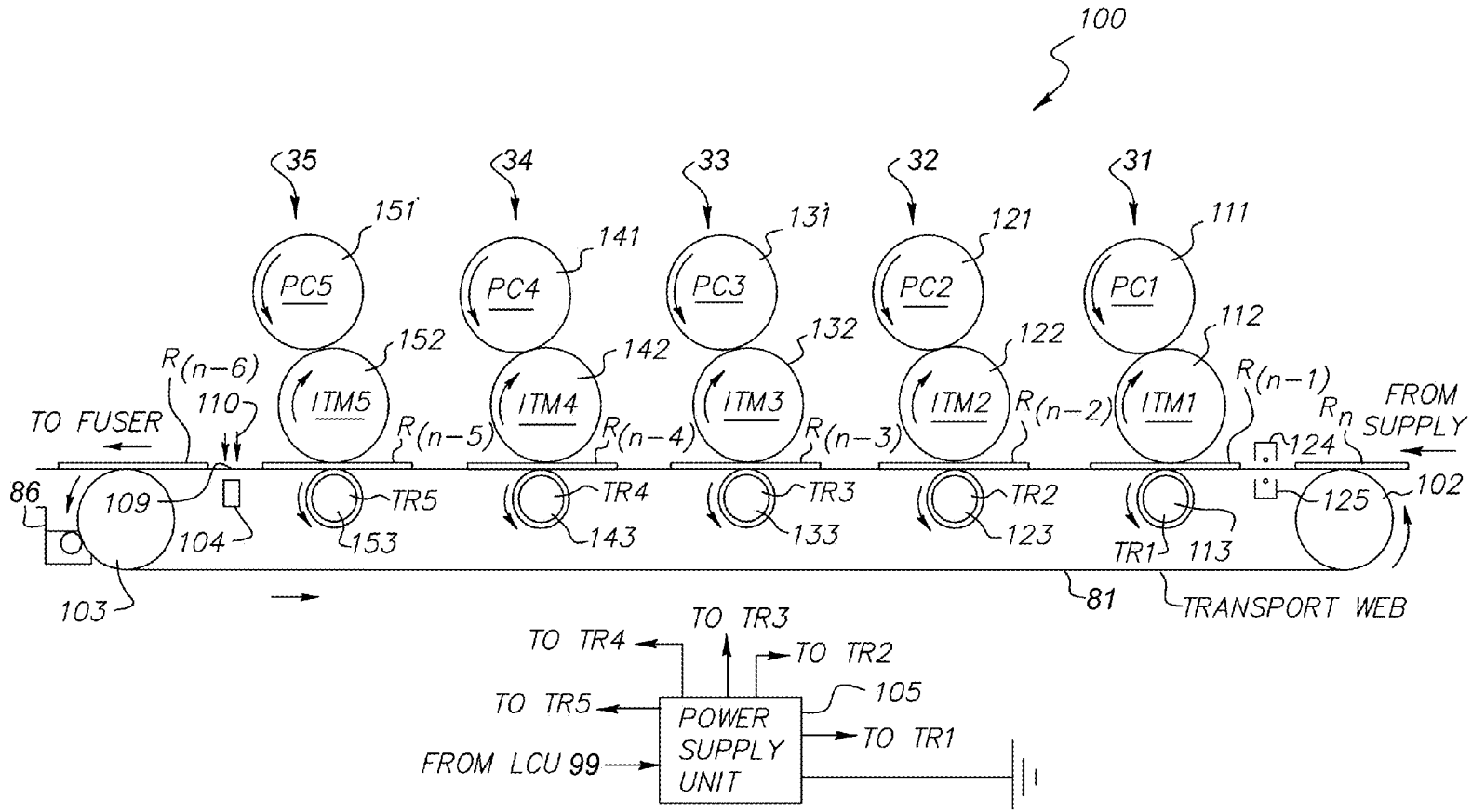
FIG. 2 is an elevational cross-section of the reprographic image-producing portion of the apparatus of FIG. 1.
Figure 3:
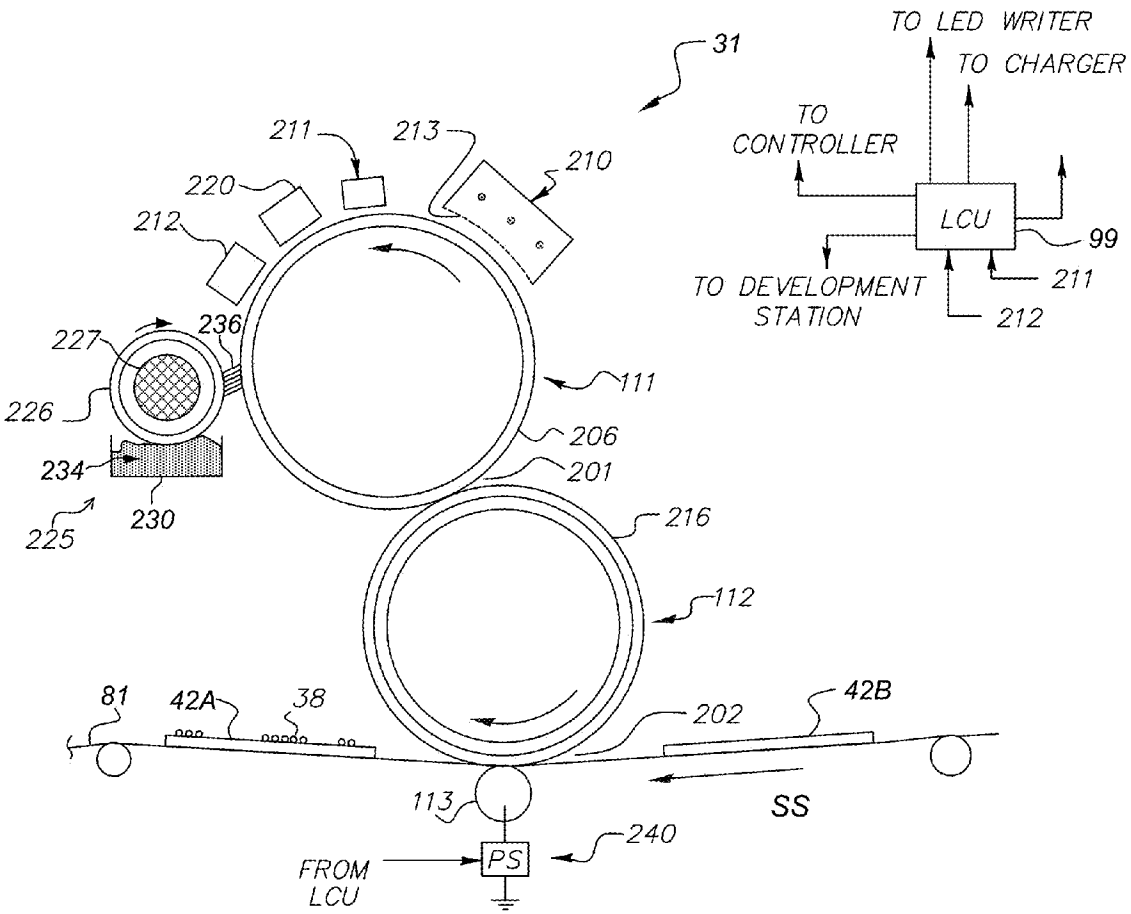
FIG. 3 is an elevational cross-section of one printing module of the apparatus of FIG. 1.

FIGS. 1-3 are elevational cross-sections showing portions of a typical electrophotographic printer 100 useful with various embodiments. Printer 100 is adapted to produce images, such as single-color (monochrome), CMYK, or pentachrome (five-color) images on a receiver (multicolor images are also known as "multi-component" images). Images can include text, graphics, photos, and other types of visual content. One embodiment involves printing using an electrophotographic print engine having five sets of single-color image-producing or printing stations or modules arranged in tandem, but more or less than five colors can be combined on a single receiver. Other electrophotographic writers or printer apparatus can also be included. Various components of printer 100 are shown as rollers; other configurations are also possible, including belts.

Referring to FIG. 1, printer 100 is an electrophotographic printing apparatus having a number of tandemly-arranged electrophotographic image-forming printing modules 31, 32, 33, 34, 35, also known as electrophotographic imaging subsystems. Each printing module 31, 32, 33, 34, 35 produces a single-color toner image for transfer using a respective transfer subsystem 50 (for clarity, only one is labeled) to a receiver 42 successively moved through the printing modules 31, 32, 33, 34, 35. Receiver 42 is transported from a supply unit 40, which can include active feeding subsystems as known in the art, into printer 100. In various embodiments, the visible image can be transferred directly from an imaging roller to the receiver 42, or from an imaging roller to one or more transfer roller(s) or belt(s) in sequence in transfer subsystem 50, and then to receiver 42. Receiver 42 is, for example, a selected section of a web of or a cut sheet of a planar medium such as paper or transparency film.

During a single pass through the five printing modules 31, 32, 33, 34, 35 each receiver 42 can have transferred in registration thereto up to five single-color toner images to form a pentachrome image. As used herein, the term "pentachrome" implies that combinations of various of the five colors are combined in a print image to form other colors on the receiver 42 at various locations on the receiver 42, and that all five colors participate to form process colors in at least some of the subsets. That is, each of the five colors of toner can be combined with toner of one or more of the other colors at a particular location on the receiver 42 to form a color different than the colors of the individual toners combined at that location. In an embodiment, printing module 31 forms black (K) print images, 32 forms yellow (Y) print images, 33 forms magenta (M) print images, and 34 forms cyan (C) print images.

Printing module 35 can form a red, blue, green, or other fifth print image, including an image formed from a clear toner (i.e. one lacking pigment). The four subtractive primary colors, cyan, magenta, yellow, and black, can be combined in various combinations of subsets thereof to form a representative spectrum of colors. The color gamut or range of the printer 100 is dependent upon the materials used and the process used for forming the colors. The fifth color can therefore be added to improve the color gamut. In addition to adding to the color gamut, the fifth color can also be a specialty color toner or spot color, such as for making proprietary logos or colors that cannot be produced with only CMYK colors (e.g., metallic, fluorescent, or pearlescent colors), or a clear toner or tinted toner. Tinted toners absorb less light than they transmit, but do contain pigments or dyes that move the hue of light passing through them towards the hue of the tint. For example, a blue-tinted toner coated on white paper will cause the white paper to appear light blue when viewed under white light, and will cause yellows printed under the blue-tinted toner to appear slightly greenish under white light.

A receiver 42A is shown after passing through printing module 35. A print image 38 on receiver 42A includes unfused toner particles.

Subsequent to transfer of the respective print images, overlaid in registration, one from each of the respective printing modules 31, 32, 33, 34, 35, receiver 42A is advanced to a fuser 60, i.e. a fusing or fixing assembly, to fuse print image 38 to receiver 42A. A transport web 81 transports the print-image-carrying receivers to fuser 60, which fixes the toner particles to the respective receivers 42A by the application of heat and pressure. The receivers 42A are serially de-tacked from transport web 81 to permit them to feed cleanly into fuser 60. Transport web 81 is then reconditioned for reuse at a cleaning station 86 by cleaning and neutralizing the charges on the opposed surfaces of transport web 81. A mechanical cleaning station (not shown) for scraping or vacuuming toner off transport web 81 can also be used independently or with cleaning station 86. The mechanical cleaning station can be disposed along transport web 81 before or after cleaning station 86 in the direction of rotation of transport web 81.

Fuser 60 includes a heated fusing roller 62 and an opposing pressure roller 64 that form a fusing nip 66 therebetween. In an embodiment, fuser 60 also includes a release fluid application substation 68 that applies release fluid, e.g., silicone oil, to fusing roller 62. Alternatively, wax-containing toner can be used without applying release fluid to fusing roller 62. Other embodiments of fusers, both contact and non-contact, can be employed. For example, solvent fixing uses solvents to soften the toner particles so they bond with the receiver 42A. Photoflash fusing uses short bursts of high-frequency electromagnetic radiation (e.g., ultraviolet light) to melt the toner. Radiant fixing uses lower-frequency electromagnetic radiation (e.g., infrared light) to more slowly melt the toner. Microwave fixing uses electromagnetic radiation in the microwave range to heat the receivers (primarily), thereby causing the toner particles to melt by heat conduction, so that the toner is fixed to the receiver 42A.

The receivers (e.g., receiver 42B) carrying the fused image (e.g., fused image 39) are transported in a series from the fuser 60 along a path either to a remote output tray 69, or back to printing modules 31, 32, 33, 34, 35 to create an image on the backside of the receiver 42B, i.e. to form a duplex print. Receivers 42B can also be transported to any suitable output accessory. For example, an auxiliary fuser or glossing assembly can provide a clear-toner overcoat. Printer 100 can also include multiple fusers 60 to support applications such as overprinting, as known in the art.

In various embodiments, between fuser 60 and output tray 69, receiver 42B passes through a finisher 70. The finisher 70 performs various paper-handling operations, such as folding, stapling, saddle-stitching, collating, and binding.

Printer 100 includes main printer apparatus logic and control unit (LCU) 99, which receives input signals from the various sensors associated with printer 100 and sends control signals to the components of printer 100. LCU 99 can include a microprocessor incorporating suitable look-up tables and control software executable by the LCU 99. It can also include a field-programmable gate array (FPGA), programmable logic device (PLD), programmable logic controller (PLC) (with a program in, e.g., ladder logic), microcontroller, or other digital control system. LCU 99 can include memory for storing control software and data. Sensors associated with the fusing assembly provide appropriate signals to the LCU 99. In response to the sensors, the LCU 99 issues command and control signals that adjust the heat or pressure within fusing nip 66 and other operating parameters of fuser 60 for receivers 42, 42A, 43B. This permits printer 100 to print on receivers of various thicknesses and surface finishes, such as glossy or matte.

Image data for writing by printer 100 can be processed by a raster image processor (RIP; not shown), which can include a color separation screen generator or generators. The output of the RIP can be stored in frame or line buffers for transmission of the color separation print data to each of the respective LED writers, e.g., for black (K), yellow (Y), magenta (M), cyan (C), and red (R), respectively. The RIP or color separation screen generator can be a part of printer 100 or remote therefrom. Image data processed by the RIP can be obtained from a color document scanner or a digital camera or produced by a computer or from a memory or network which typically includes image data representing a continuous image that needs to be reprocessed into halftone image data in order to be adequately represented by the printer. The RIP can perform image processing processes, e.g., color correction, in order to obtain the desired color print. Color image data is separated into the respective colors and converted by the RIP to halftone dot image data in the respective color using matrices, which include desired screen angles (measured counterclockwise from rightward, the +X direction) and screen rulings. The RIP can be a suitably-programmed computer or logic device and is adapted to employ stored or computed matrices and templates for processing separated color image data into rendered image data in the form of halftone information suitable for printing. These matrices can include a screen pattern memory (SPM).

Further details regarding printer 100 are provided in U.S. Pat. No. 6,608,641, issued on Aug. 19, 2003, to Peter S. Alexandrovich et al., and in U.S. Patent Application Publication No. 2006/0133870, published on Jun. 22, 2006, by Yee S. Ng et al., the disclosures of which are incorporated herein by reference.

Referring to FIG. 2, receivers $R_n$-$R_{(n-6)}$ are delivered from supply unit 40 (FIG. 1) and transported through the printing modules 31, 32, 33, 34, 35. The receivers $R_n$-$R_{(n-6)}$ are adhered (e.g., electrostatically using coupled corona tack-down chargers 124, 125) to the endless transport web 81 entrained and driven about rollers 102, 103. Each of the printing modules 31, 32, 33, 34, 35 includes a respective imaging member (111, 121, 131, 141, 151), e.g., a roller or belt, an intermediate transfer member (112, 122, 132, 142, 152), e.g., a blanket roller, and transfer backup member (113, 123, 133, 143, 153), e.g., a roller, belt or rod. Thus in printing module 31, a print image (e.g., a black separation image) is created on imaging member PC1 (111), transferred to intermediate transfer member ITM1 (112), and transferred again to receiver $R_{(n-1)}$ moving through transfer subsystem 50 (FIG. 1) that includes transfer member ITM1 (112) forming a pressure nip with a transfer backup member TR1 (113). Similarly, printing modules 32, 33, 34, and 35 include, respectively: PC2, ITM2, TR2 (121, 122, 123); PC3, ITM3, TR3 (131, 132, 133); PC4, ITM4, TR4 (141, 142, 143); and PC5, ITM5, TR5 (151, 152, 153). The direction of transport of the receivers is the slow-scan direction; the perpendicular direction, parallel to the axes of the intermediate transfer members (112, 122, 132, 142, 152), is the fast-scan direction.

A receiver, $R_n$, arriving from supply unit 40 (FIG. 1), is shown passing over roller 102 for subsequent entry into transfer subsystem 50 (FIG. 1) of first printing module 31 in which the preceding receiver $R_{(n-1)}$ is shown. Similarly, receivers $R_{(n-2)}$, $R_{(n-3)}$, $R_{(n-4)}$, and $R_{(n-5)}$ are shown moving respectively through the transfer subsystems (for clarity, not labeled) of printing modules 32, 33, 34, and 35. An unfused print image formed on receiver $R_{(n-6)}$ is moving as shown towards fuser 60 (FIG. 1).

A power supply 105 provides individual transfer currents to the transfer backup members 113, 123, 133, 143, and 153. LCU 99 (FIG. 1) provides timing and control signals to the components of printer 100 in response to signals from sensors in printer 100 to control the components and process control parameters of the printer 100. The cleaning station 86 for transport web 81 permits continued reuse of transport web 81.

A densitometer includes a transmission densitometer array 104 using a light beam 110 and a light sensor 106. The densitometer array 104 includes channels for measuring red, green, and blue density and a channel that is visually weighted. The channels are red transmission densitometer 104R, green densitometer 104G, blue densitometer 104B, and visually weighted densitometer 104V. The densitometer array 104 measures optical densities of five toner control patches transferred to an interframe area 109 located on transport web 81, such that one or more signals are transmitted from the densitometer array 104 to a computer or other controller (not shown) with corresponding signals sent from the computer to power supply 105. Transmission densitometer array 104 is preferably located between printing module 35 and roller 103. Reflection densitometers, and more or fewer test patches, can also be used.

FIG. 3 shows more details of printing module 31, which is representative of printing modules 32, 33, 34, and 35 (FIG. 1). A primary charging subsystem 210 uniformly electrostatically charges a photoreceptor 206 of imaging member 111, shown in the form of an imaging cylinder. Charging subsystem 210 includes a grid 213 having a selected voltage. Additional components provided for control can be assembled about the various process elements of the respective printing modules. A meter 211 measures the uniform electrostatic charge provided by charging subsystem 210, and a meter 212 measures the post-exposure surface potential within a patch area of a latent image formed from time to time in a non-image area on photoreceptor 206. Other meters and components can be included.

LCU 99 sends control signals to the charging subsystem 210, an exposure subsystem 220 (e.g., laser or LED writers), and a respective development subsystem 225 of each printing module 31, 32, 33, 34, 35 (FIG. 1), among other components. Each printing module 31, 32, 33, 34, 35 can also have its own respective controller (not shown) coupled to LCU 99.

Imaging member 111 includes photoreceptor 206. Photoreceptor 206 includes a photoconductive layer formed on an electrically conductive substrate. The photoconductive layer is an insulator in the substantial absence of light so that electric charges are retained on its surface. Upon exposure to light, the charge is dissipated. In various embodiments, photoreceptor 206 is part of, or disposed over, the surface of imaging member 111, which can be a plate, drum, or belt. Photoreceptors 206 can include a homogeneous layer of a single material such as vitreous selenium or a composite layer containing a photoconductor and another material. Photoreceptors 206 can also contain multiple layers.

The exposure subsystem 220 is provided for image-wise modulating the uniform electrostatic charge on photoreceptor 206 by exposing photoreceptor 206 to electromagnetic radiation to form a latent electrostatic image (e.g., of a separation corresponding to the color of toner deposited at this printing module). The uniformly-charged photoreceptor 206 is typically exposed to actinic radiation provided by selectively activating particular light sources in an LED array or a laser device outputting light directed at photoreceptor 206. In embodiments using laser devices, a rotating polygon (not shown) is used to scan one or more laser beam(s) across the photoreceptor 206 in the fast-scan direction. One addressable dot site is exposed at a time, and the intensity or duty cycle of the laser beam is varied at each dot site. In embodiments using an LED array, the array can include a plurality of LEDs arranged next to each other in a line, all addressable dot sites in one row of dot sites on the photoreceptor 206 can be selectively exposed simultaneously, and the intensity or duty cycle of each LED can be varied within a line exposure time to expose each dot site in the row during that line exposure time.

As used herein, an "engine pixel" is the smallest addressable unit on photoreceptor 206 which the light source (e.g., laser or LED) can expose with a selected exposure different from the exposure of another engine pixel. Engine pixels can overlap, e.g., to increase addressability in the slow-scan direction (SS). Each engine pixel has a corresponding engine pixel location, and the exposure applied to the engine pixel location is described by an engine pixel level.

The exposure subsystem 220 can be a write-white or write-black system. In a write-white or charged-area-development (CAD) system, the exposure dissipates charge on areas of photoreceptor 206 to which toner should not adhere. Toner particles are charged to be attracted to the charge remaining on photoreceptor 206. The exposed areas therefore correspond to white areas of a printed page. In a write-black or discharged-area development (DAD) system, the toner is charged to be attracted to a bias voltage applied to photoreceptor 206 and repelled from the charge on photoreceptor 206. Therefore, toner adheres to areas where the charge on photoreceptor 206 has been dissipated by exposure. The exposed areas therefore correspond to black areas of a printed page.

The development subsystem 225 includes a toning shell 226, which can be rotating or stationary, for applying toner of a selected color to the latent image on photoreceptor 206 to produce a visible image on photoreceptor 206. Development subsystem 225 is electrically biased by a suitable respective voltage to develop the respective latent image, which voltage can be supplied by a power supply (not shown). Developer is provided to toning shell 226 by a supply system (not shown), e.g., a supply roller, auger, or belt from a developer sump 230. Toner is transferred by electrostatic forces from development subsystem 225 to photoreceptor 206. These forces can include Coulombic forces between charged toner particles and the charged electrostatic latent image, and Lorentz forces on the charged toner particles due to the electric field produced by the bias voltages.

Figure 4:
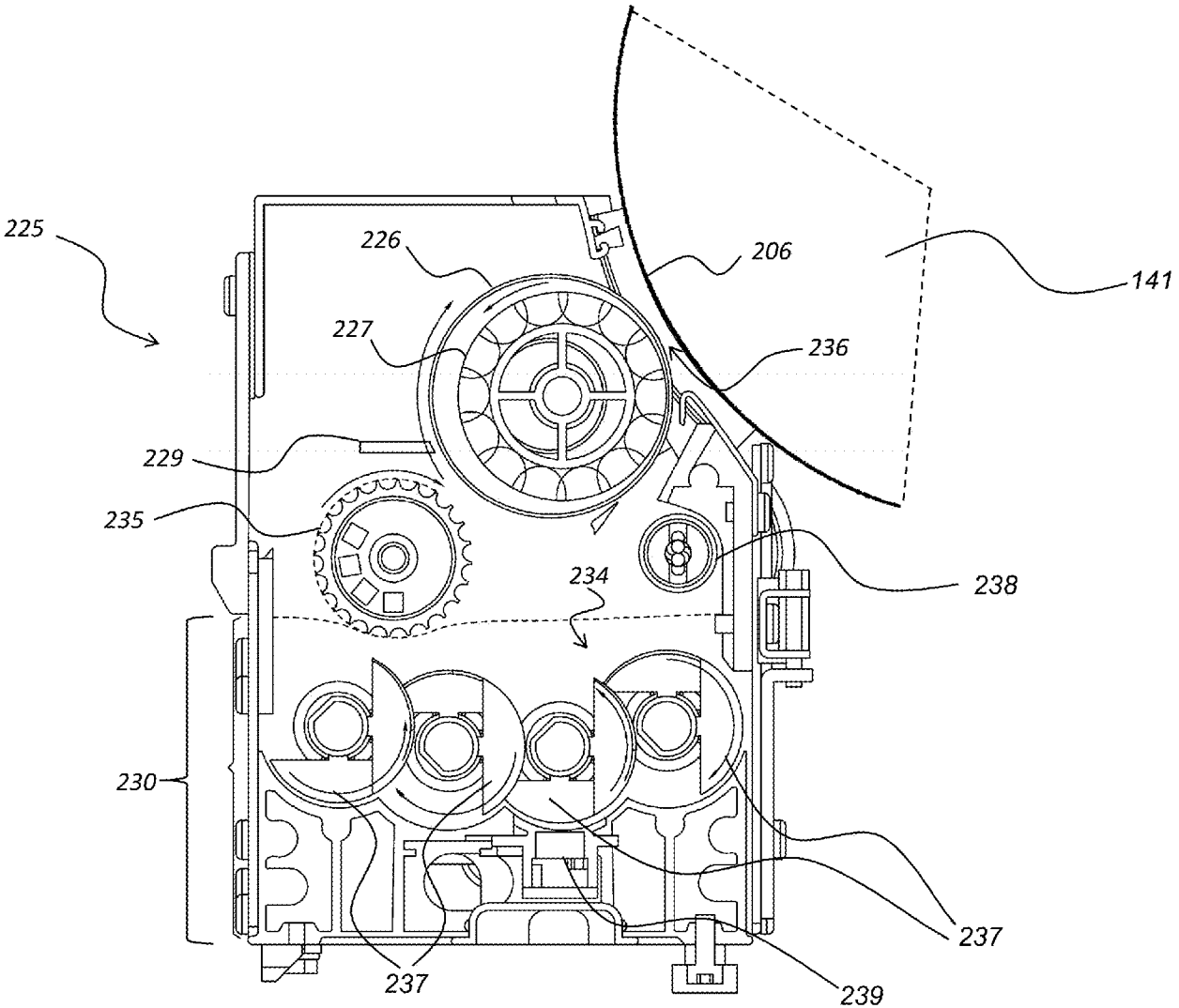
FIG. 4 is an elevational cross-section of the development subsystem of the printing module of FIG. 3.
Figure 9:
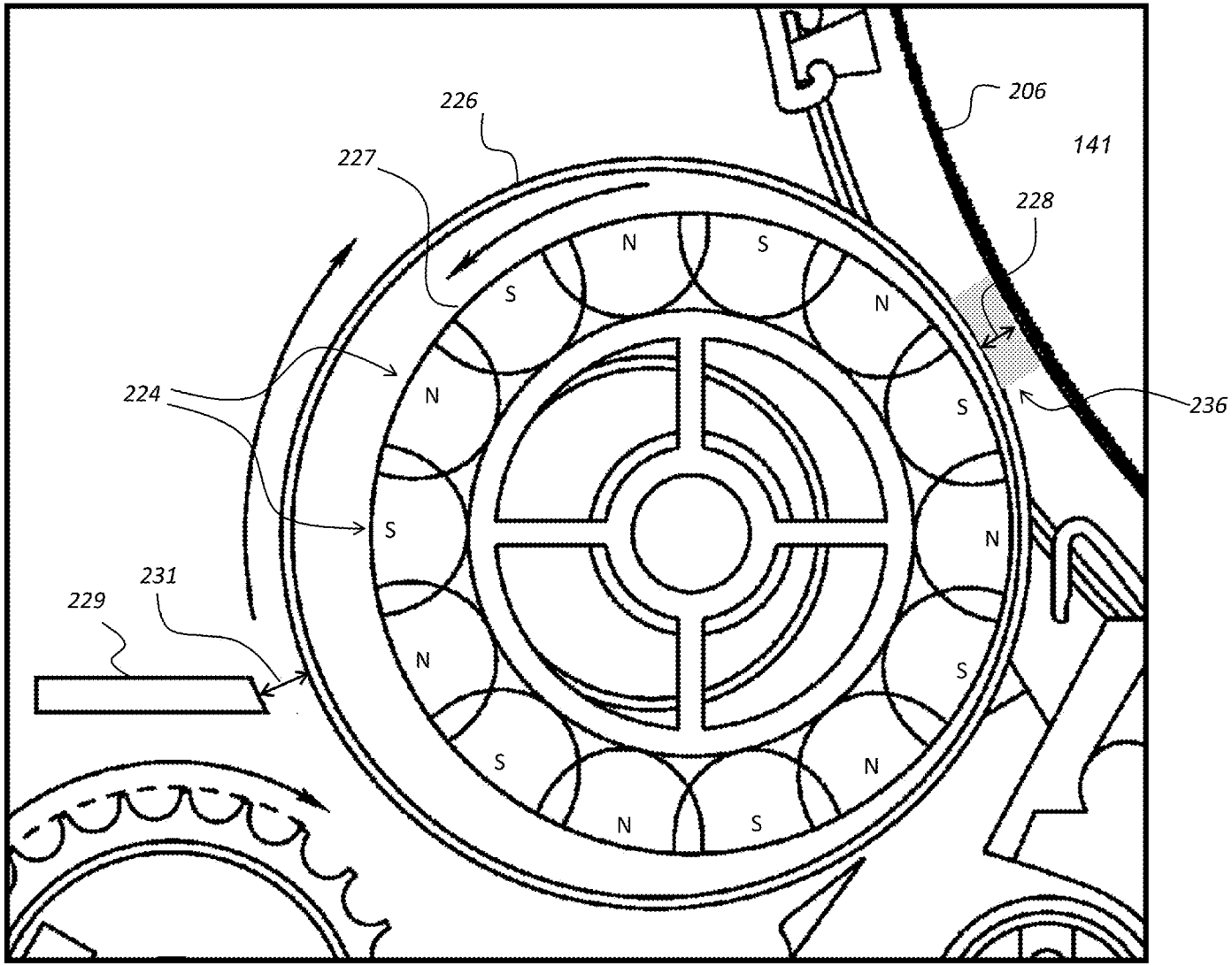
FIG. 9 is a detail elevational cross section of the region surrounding the toning roller of the development subsystem of FIG. 4.

FIG. 4 shows a more detailed view of development subsystem 225, which employs a two-component developer 234 that includes toner particles and magnetic carrier particles. Development subsystem 225 includes a magnetic core 227 to cause the magnetic carrier particles near toning shell 226 to form a "magnetic brush," as known in the electrophotographic art. In this embodiment magnetic core 227 rotates in a direction opposite to toning shell 226, but it can be stationary or rotating, and can rotate with a speed and direction the same as or different than the speed and direction of toning shell 226. Magnetic core 227 has fourteen alternating north (N) and south (S) magnetic poles 224 (FIG. 9) around its circumference in the embodiment shown in FIG. 4. However, magnetic core 227 can be cylindrical or non-cylindrical, and can include a single magnet or a plurality of magnets or magnetic poles 224 disposed around the circumference of magnetic core 227. Alternatively, magnetic core 227 can include an array of solenoids driven to provide a magnetic field of alternating direction. Magnetic core 227 preferably provides a magnetic field of varying magnitude and direction around the outer circumference of toning shell 226. Further details of magnetic core 227 can be found in U.S. Pat. No. 7,120,379 to Eck et al., issued Oct. 10, 2006, and in U.S. Patent Application Publication No. 2002/0168200 to Stelter et al., published Nov. 14, 2002, the disclosures of which are incorporated herein by reference. Development subsystem 225 can also employ a mono-component developer including toner, either magnetic or non-magnetic, without separate magnetic carrier particles.

A feed roller 235 transports developer 234 from developer sump 230, which includes mixers 237, to toning shell 226. A metering skive 229, positioned in proximity to toning shell 226 between feed roller 235 and toning zone 236, is used to control the amount of developer 234 that is transported to a toning zone 236. Toner is transferred from toning shell 226 to photoreceptor 206 in toning zone 236. As described above, toner is selectively supplied to photoreceptor 206 by toning shell 226.

Toner is removed from developer 234 to develop the latent image on photoreceptor 206 in toning zone 236, and it is necessary to replenish the developer 234 with fresh toner to maintain the properties of the developer 234. A signal from a toner monitor 239 is used as a measure of the percentage of toner in developer 234 and this signal is sent to LCU 99 (FIG. 3). The replenishment tube 238 is controlled by LCU 99 in response to the signal from toner monitor 239 to deliver fresh toner to developer 234 in developer sump 230 to maintain the toner concentration and properties of developer 234. In this embodiment toner monitor 239 measures the magnetic properties of the magnetic carrier in developer 234 by sensing the magnetic permeability of the developer 234. The magnetic permeability of developer 234 is dependent on the magnetic properties of the magnetic carrier and the concentration of the magnetic carrier in the sample presented to the sensing region of toner monitor 239. The concentration of magnetic carrier in the developer 234 is related to the concentration of toner in developer 234. Control of a replenishment tube 238 can be dependent on factors such as the number of imaging pixels written, the number of pages printed, the working life of the developer 234, or the signal from toner monitor 239.

As toner is added to developer 234 by replenishment tube 238 it should be quickly mixed into developer 234, charged to an appropriate level, and transported to feed roller 235 so that the developer 234 delivered to a toning zone 236 is homogeneous and uniformly charged. This is accomplished by mixers 237 in developer sump 230. The mixing and transport of developer 234 is dependent on the powder flow properties of developer 234. A more cohesive developer 234 requires that more power be provided to mixers 237 to mix and transport the developer 234.

Referring to FIG. 3, transfer subsystem 50 (FIG. 1) includes transfer backup member 113, and intermediate transfer member 112 for transferring the respective print image from photoreceptor 206 of imaging member 111 through a first transfer nip 201 to a surface 216 of intermediate transfer member 112, and thence to a receiver (e.g., 42B) which receives the respective toned print images 38 from each printing module in superposition to form a composite image thereon. Print image 38 is e.g., a separation of one color, such as black. Receivers are transported by transport web 81. Transfer to a receiver is affected by an electrical field provided to transfer backup member 113 by power source 240, which is controlled by LCU 99. Receivers can be any objects or surfaces onto which toner can be transferred from imaging member 111 by application of the electric field. In this example, receiver 42B is shown prior to entry into second transfer nip 202, and receiver 42A is shown subsequent to transfer of the print image 38 onto receiver 42A.

Figure 5:
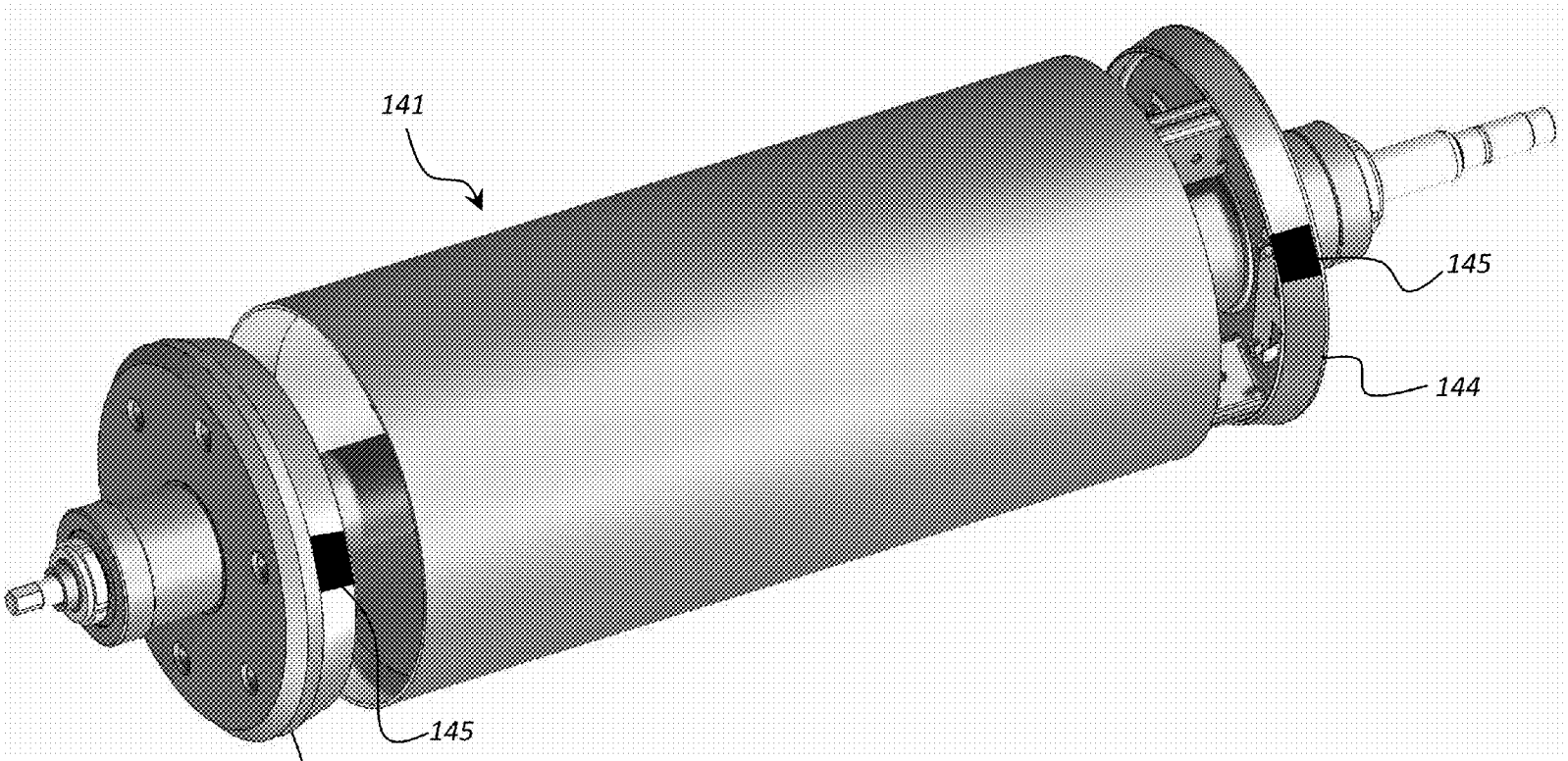
FIG. 5 shows the imaging member and associated mounting hardware of the printing module of FIG. 3.
Figure 6:
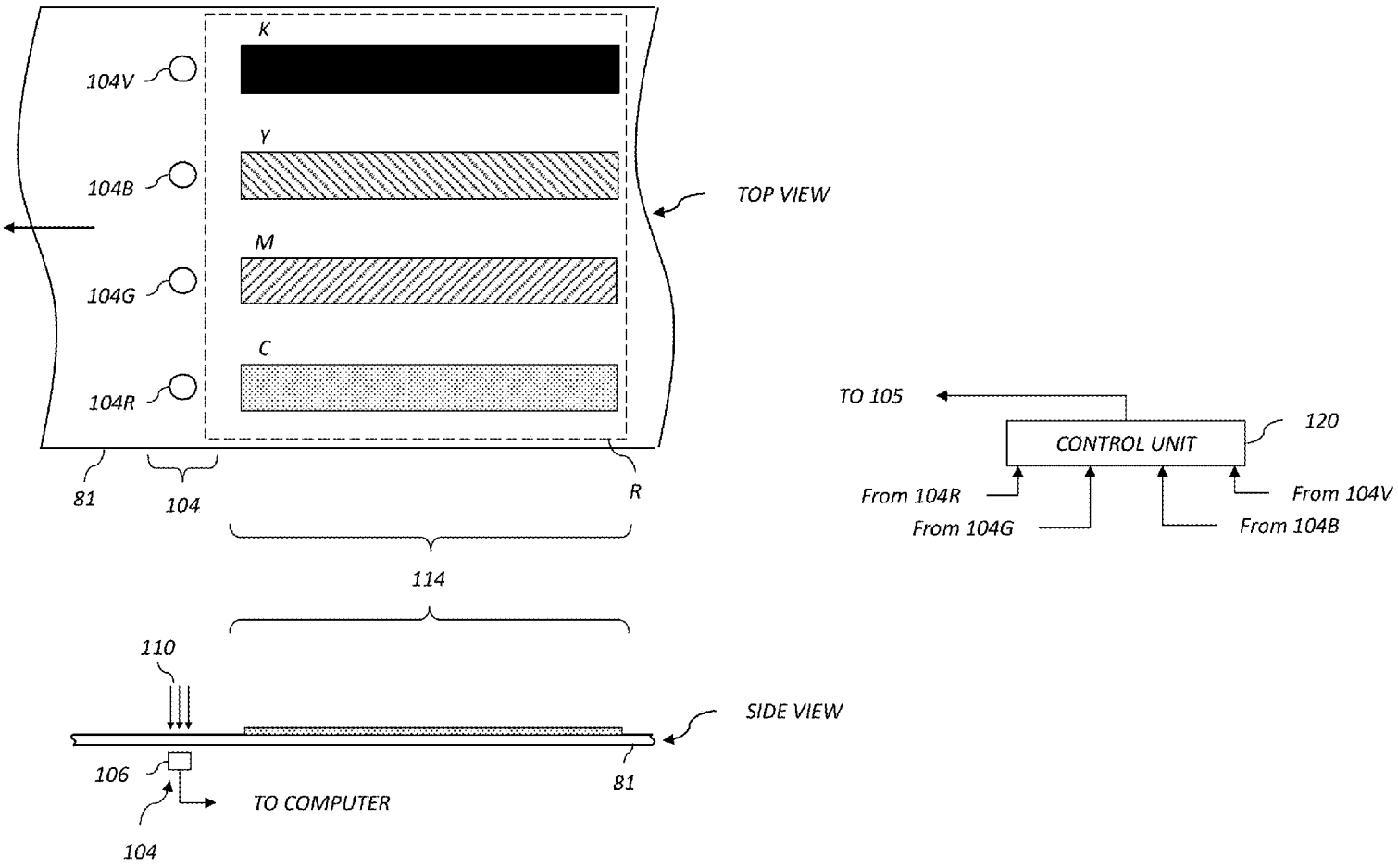
FIG. 6 shows schematic top and side views of the densitometer module portion of the electrophotographic reproduction apparatus of FIG. 1.

The sensitivity of the toning process and the resulting print density to the spacing between toning shell 226 and photoreceptor 206 in toning zone 236 was evaluated on a NexPress Digital Production Color Press operating at a printing speed of 514 millimeters per second. A standard developer load of 1300 grams of the developer 234 to be examined was placed in development subsystem 225 and printer 100 was operated in a special printing mode that will be described below. The developer 234 to be examined was generally cyan and placed in cyan imaging module 34 (FIG. 2), although some other developer colors were evaluated in other imaging modules. In FIG. 5, it is shown how a variation in a toning zone spacing 228 (FIG. 9) was induced in the cyan printing module 34 by placing shims 145 between the inside wall of imaging member 141 and gudgeons 144 used to mount the imaging member 141 in the cyan printing module 34. The shims 145 were generally fashioned of 0.002 inch thick adhesive tape which created an induced runout of 0.0007 inches at the cross track location of red transmission densitometer 104R (FIG. 6). The induced runout was introduced so that a larger signal indicative of the sensitivity of the toning process to the spacing between toning shell 226 and photoreceptor 206 would be produced.

Figure 7:
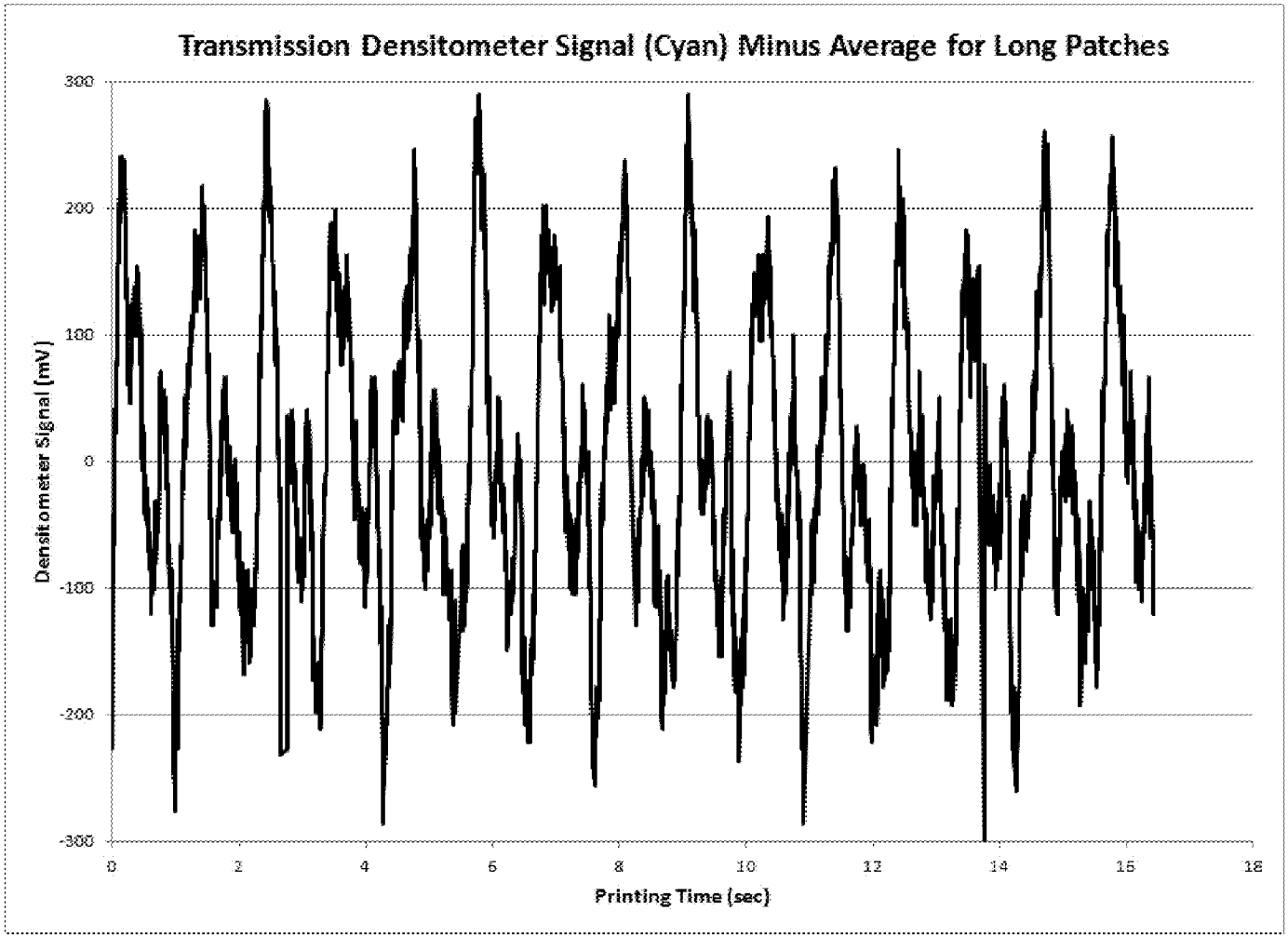
FIG. 7 is an exemplary time domain plot of the red densitometer signal vs. printing time for a long cyan patch printed on the transport web.
Figure 8:
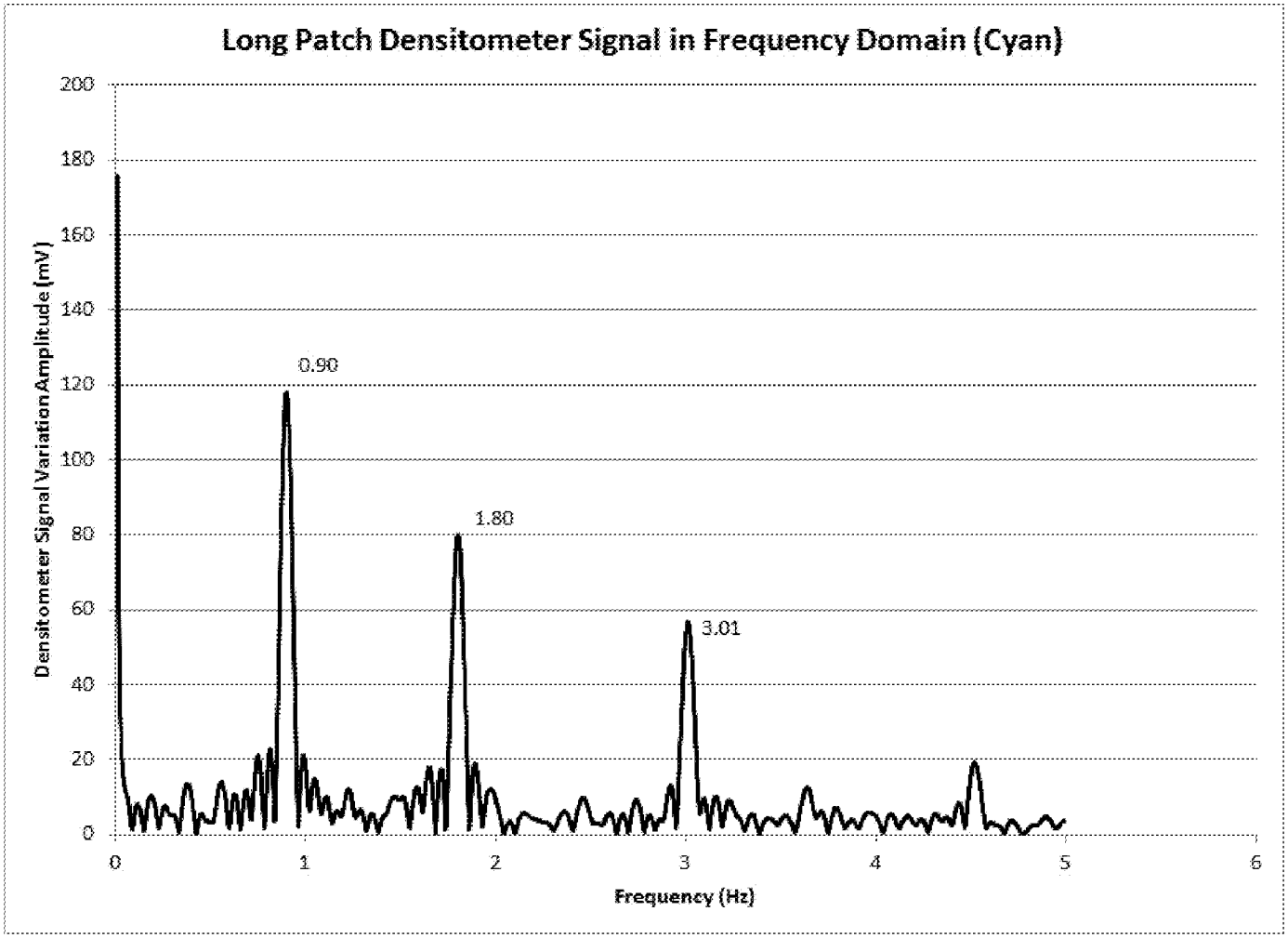
FIG. 8 is an exemplary frequency domain plot of the red densitometer signal variation amplitude vs. temporal frequency for a long cyan patch printed on the transport web.

The special printing mode used to determine the sensitivity of the development process to toning zone spacing 228 used transmission densitometer array 104 installed about transport web 81 to measure the amount of toner developed and transferred to transport web 81 as shown in FIG. 6. Six consecutive 54 inch long maximum density patches 114 were printed and transferred directly to transport web 81. The output voltage of red transmission densitometer 104R, which is related to the amount of cyan toner developed and transferred to transport web 81, was recorded by a control unit 120 as the long maximum density patches 114 passed through red transmission densitometer 104R. An example of the collected data is shown in FIG. 7, which is a plot of the transmission densitometer signal of red transmission densitometer 104R versus time as the six consecutive 54 inch long maximum density patches 114 pass through red transmission densitometer 104R. An exemplary frequency domain plot of the transmission densitometer signal is shown in FIG. 8, where the densitometer signal variation amplitude in millivolts is plotted versus the frequency of the signal variation in Hertz. In FIG. 8, there are three major signal peaks in the frequency domain spectrum. These correspond to the rotational frequency of imaging member 141 at 0.90 Hz, double the rotation frequency of imaging member 141 at 1.80 Hz, and double the rotation frequency of toning shell 226 at 3.01 Hz. The densitometer signal variation amplitudes at the frequencies corresponding to the rotational frequencies and harmonics of the rotational frequencies of imaging member 141 (0.90 Hz) and toning shell 226 (1.50 Hz) are used to assess the sensitivity of the toning process to variations in the toning zone spacing 228 shown in FIG. 9.

Imperfections in toning shell 226, imaging member 141, and the associated components that mount them in printing module 34 can cause a variation in toning zone spacing 228. Examples of imperfections that will cause a variation in toning zone spacing 228 are a deviation from cylindricity of toning shell 226 or imaging member 141. Shims 145 (FIG. 5) are used to simulate imperfect cylindricity of imaging member 141, thus producing a variation in toning zone spacing 228 that can be used to assess how different magnetic carrier materials perform in reducing the sensitivity of the toning process to toning zone spacing variability.

The present invention provides an improved two-component toning process based on a magnetic brush assembly with a rotating magnetic core within a conductive, non-magnetic sleeve, through the use of strontium-lithium ferrite (SLF) composite carrier materials based on magnetically soft lithium ferrite and magnetically hard strontium ferrite intermixed within the same carrier particles. Detailed descriptions of these materials follow later in the specification.

Measurements of the sensitivity of the toning process to toning zone spacing were made for three different magnetic carrier materials and also at different developer mass area densities (DMAD). DMAD is defined as the mass of developer present in the toning zone per unit area of the toning shell and the units are grams of developer per square inch. DMAD can be controlled by adjusting metering skive spacing 231, which is the distance between metering skive 229 and toning shell 226. In these measurements, metering skive spacings of 0.035", 0.042", 0.049", and 0.056" were used.

Table 1 summarizes measurements of the toning spacing sensitivity for three different magnetic carrier materials and for different metering skive spacings. The toning spacing sensitivity is represented by the sum of the densitometer signal variation amplitudes in millivolts at 0.9 Hz, 1.8 Hz, 2.7 Hz, and 3.6 Hz, the frequency of the rotation of imaging member 141 and several harmonics of this frequency. At a metering skive spacing of 0.049 inches, the toning spacing sensitivity as represented by the densitometer signal variation amplitude sum is seen to decrease from 198 mV for the hard magnetic material FCS150 to 61 mV for the softer magnetic carrier material SLF(3). SLF(3) refers to an SLF hard/soft composite material at 67 mole % lithium ferrite identified as Sample 3 in Table 5. The physical blend mixture of the two types of magnetic carrier material, 50% FCS150/50% SLF(3) (w/w), has a toning spacing sensitivity of 126 mV. There is a trend of decreasing toning spacing sensitivity with increasing soft magnetic component of the magnetic carrier material.

TABLE 1

Toning Spacing Sensitivity

| | Metering Skive Gap (inches) | | | |
|---|---|---|---|---|
| Carrier Material | 0.035 | 0.042 | 0.049 | 0.056 |
| FCS-150 | — | 215 | 198 | 215 |
| 50% SLF(3)/ 50% FCS-150 | — | 177 | 126 | — |
| SLF(3) | 69 | 56 | 61 | 64 |

Table 2 summarizes the developer mass area densities (DMAD) measured for the tested developers at the various metering skive spacings. DMAD increases as the metering skive gap is increased and also as the percentage of softer magnetic material, SLF, is increased.

TABLE 2

DMAD (grams/square inch) at Metering Skive Gap

| | Metering Skive Cap (inches) | | | |
|---|---|---|---|---|
| Carrier Material | 0.035 | 0.042 | 0.049 | 0.056 |
| FCS-150 | — | 0.242 | 0.286 | 0.327 |
| 50% SLF(3)/ 50% FCS-150 | — | 0.304 | 0.362 | — |
| SLF(3) | 0.321 | 0.381 | 0.426 | 0.552 |

The improved two-component SPD toning process with reduced toning spacing sensitivity of the present invention is achieved through the use of strontium-lithium ferrite composite carrier materials based on magnetically hard strontium ferrite and magnetically soft lithium ferrite intermixed within the same carrier particles. Exemplary samples of such SLF composite carriers were prepared from $SrCO_3$, $Fe_2O_3$ and $Li_2CO_3$, using amounts designed to produce mixtures of lithium ferrite with a stoichiometric composition of $LiFe_5O_8$, and strontium ferrite with a stoichiometric composition of $SrFe_{12}O_{19}$, over a range of ratios of lithium ferrite to strontium ferrite. Table 3 describes such samples where the composition of the composite is specified as mole % lithium ferrite. These samples range from 20 to 66.7 mole % lithium ferrite, which corresponds to 8.9 to 43.9 weight % lithium ferrite, or 1490 to 7350 ppm Li. The amount of $SrCO_3$ added was calculated to yield a 5 mole % excess SrO component. Such excess strontium is used as a fluxing agent to insure adequate sintering of the crystals of strontium ferrite when it is prepared by itself for use in two-component developer compositions. Using the 50% soft ferrite sample as the example, a slurry was prepared by adding 306.55 g of $Fe_2O_3$ powder (α-phase from Merox), 35.11 g of $SrCO_3$ powder (Type D available from Chemical Products Corporation of Cartersville, Ga.), and 8.34 g of $Li_2CO_3$ (Alfa Aesar, Regent Grade) to 350 g of an aqueous binder solution to a 1250 ml glass bottle. A binder solution was prepared by adding 47.7 g of an 11 wt. % polyvinyl alcohol concentrate (prepared from Airvol® 205S PVA), 1.75 g of Dispex® A40 from Ciba (BASF), 300.7 g of deionized water, and 4 ml of concentrated $NH_4OH$. To the slurry was added 875 g of 1 mm zirconia silicate media beads and the resulting mixture was rolled in a roll mill for at least 24 hours. The resulting milled dispersion was pumped to a rotary atomizer operating at a speed of at 18,000 revolutions per minute (rpm) on a laboratory spray dryer, a portable model available from Niro Atomizer of Copenhagen, Denmark. The spray dryer produced a dried product ("green bead") that was collected with a cyclone. Firing of the green beads was conducted by placing them in alumina trays and charging them into a high temperature box furnace. The temperature of the furnace was ramped at a rate of 7° C./min to a temperature of 500° C., at which point the temperature was maintained at 500° C. for 1 hour to burnout the binder portion of the green bead. Subsequently, the furnace temperature was ramped at a rate of 5° C./min to the final firing temperature. The furnace was held at the selected firing temperature for 10 hours, whereupon the furnace was allowed to cool without control to room temperature. Firing temperatures were varied from 1050° C. to 1225° C. The fired samples were de-agglomerated using a mortar and pestle and screened through a 200 mesh screen to obtain the composite composition. The composite particle size was measured on an Aerosizer® time of flight instrument. The distributions were single mode and comparable in fines and width to standard FCS $SrFe_{12}O_{19}$ production core provided by Powdertech Corporation (Kashiwa, Japan). The composite compositions were scanned on an Enraf-Nonius Guiner X-ray Camera unit using Mo radiation, with an Eastman Kodak Company Computed Radiography capture system and scanned with a CR500 scanner. All firings at 1050° C. and above showed only the ordered $LiFe_5O_8$ phase and the M magnetoplumbite form of $SrFe_{12}O_{19}$. No impurity phases were detected. The sample inventive compositions are described in Table 3, including the volume median particle diameter measured on the Aerosizer. Comparative examples of 100% lithium ferrite and 100% strontium ferrite were also prepared by the same techniques.

TABLE 3

| Mole % Lithium Ferrite | $SrCO_3$ grams | $Fe_2O_3$ grams | $Li_2CO_3$ grams | Dvol microns |
|---|---|---|---|---|
| 20.0 | 44.5 | 302.86 | 2.64 | 25.2 |

TABLE 3-continued

| Mole % Lithium Ferrite | $SrCO_3$ grams | $Fe_2O_3$ grams | $Li_2CO_3$ grams | Dvol microns |
|---|---|---|---|---|
| 28.6 | 42.4 | 303.74 | 4.02 | 25.6 |
| 40.0 | 38.74 | 305.12 | 6.14 | 27.1 |
| 50.0 | 35.11 | 306.55 | 8.34 | 27.6 |
| 66.7 | 27.4 | 309.58 | 13.02 | 29.5 |

The magnetic properties in the form of hysteresis loops for a particularly useful SLF hard/soft composite material at 67 mole % lithium ferrite, and the comparison pure hard magnetic component strontium ferrite (FCS-200 from Powdertech) and pure soft magnetic component lithium ferrite (Eastman Kodak laboratory sample preparation method as described above) are illustrated in FIG. 10. Such hysteresis loops describe the magnetization of the sample in the units of emu/g as a function of the applied magnetic field in units of Oe where the field is taken from 0 to 10,000 Oe, taken to 10,000 Oe in the opposite polarity, and then returned to 10,000 Oe in the original direction. These data and the other measurements reported in the present invention were collected with a Lakeshore Vibrating Sample Magnetometer (VSM) equipped with a model 735 Controller, a model 450 Gaussmeter, and a model 665 Magnet Power Supply. Samples for measurement in the form of pellets were prepared by mixing precisely weighed amounts of the magnetic carrier powder in question with precisely weighed amounts of Kodak NexPress toner at a ratio of about 4 to 1 carrier to toner, loading the mixture into a 3 mm diameter tube, vapor fusing the mixture of powders together by placing the tube in a jar above dichloromethane solvent, removing the solvent from the slug of toner-carrier mixture by keeping at room temperature in a laboratory fume hood until constant weight was achieved, followed by cutting the sample to a final pellet of precisely measured weight in the range of 0.05 grams. The toner component of the mixture is caused to flow by the solvent vapor; after removing the solvent the result is a frozen magnetic powder pellet sample wherein the carrier particles are not free to move when subject to a magnetic field. The pellet is then mounted on the sample spindle of the VSM. The FCS-200 strontium ferrite hard magnetic carrier particles of FIG. 10 were in the as received state from the vendor, not having been subjected to a high field to magnetize them in preparation for use in an SPD two component toning process. The Lakeshore software reports the saturation Ms values as the magnetization at a field of 10,000 Oe; in the case of FCS-200, SLF (67 mole % lithium ferrite) and lithium ferrite the values are 56.9, 58.4 and 64.6 emu/g, respectively. Similarly, the values for remanence or retentivity Mr, the residual magnetization when the field is returned to zero, are 30.8, 14.4 and emu/g and 1.7 emu/g for FCS-200, SLF (67 mole % lithium ferrite) and lithium ferrite, respectively. The coercivity values Hc, the reverse field required to reduce the magnetization back to zero after having been exposed to a field of 10,000 Oe, are 1943, 446 and 21 Oe for FCS-200, SLF (67 mole % lithium ferrite) and lithium ferrite, respectively. The spinel soft ferrites do have a slight degree of residual magnetization, as typified by these Mr and Hc values. In the magnetics literature, the strength of a magnetic field is often interchangeably referred to in units of either the oersted (Oe) or gauss (G). In a medium such as air which has no magnetic permeability these have the same values. However, the gauss is the unit of magnetic flux density rather than the magnetic field. This disclosure properly uses Oe as the magnetic field unit; it should be understood that for the purposes of comparison to references such as U.S. Pat. No. 6,617,089 and U.S. Pat. No. 6,677,098, the gauss and the oersted are interchangeable. Magnetization at a specified field is the same quantity as induced moment at that specified field (as for example used in references U.S. Pat. No. 6,617,089 and U.S. Pat. No. 6,677,098). Whenever possible, cgs units are used for magnetic properties in this disclosure.

Magnetic properties of the inventive composite materials described in Table 3, and appropriate comparison lithium ferrite and strontium ferrite samples, were measured using the VSM pellet technique described previously. Included are the saturation magnetization Ms at 10000 Oe, the remanence magnetization Mr when the field is reduced to zero from 10000 Oe, and the coercivity Hc which is the value of the inverse field required to reduce the magnetization. The results are shown in Table 4 for a series of samples fired at 1225° C. All of these SLF samples flow appropriately on an "off-line" rotating core magnetic brush assembly without exhibiting the freezing process discussed previously; lithium ferrite itself aggregates into frozen stripes of material. All of these SLF composite materials have coercivity values greater than 300 Oe.

TABLE 4

| Mole % Lithium Ferrite | Firing Temp. deg C | Ms emu/g | Mr emu/g | Hc Oe |
|---|---|---|---|---|
| 0 | 1225 | 53.8 | 32.9 | 2473 |
| 20.0 | 1225 | 55.2 | 18.3 | 913 |
| 28.6 | 1225 | 55.7 | 18.6 | 927 |
| 40.0 | 1225 | 57.2 | 16.2 | 687 |
| 50.0 | 1225 | 62.2 | 18.1 | 669 |
| 66.7 | 1225 | 59.6 | 11.9 | 349 |
| 100 | 1225 | 69.5 | 1.0 | 12 |

The materials of Tables 3 and 4 were produced on laboratory scale equipment at Eastman Kodak Co., at quantities too small to be tested on the NexPress printer described earlier. Composite particles of strontium and lithium ferrite were prepared on pilot and production equipment by Powdertech Corp of Japan, using the same steps as the laboratory samples, but at larger scale. The mole % of lithium in the strontium-lithium ferrite composite was varied from 50% to 85%. The electrophotographic process performance results described earlier, illustrative of the advantages of the present invention, were from experiments conducted with these samples on the NexPress printer. Table 5 describes these materials. Particle size measured on an Aerosizer is reported as the volume median diameter in microns. Magnetic properties of these inventive composite materials were measured using the VSM pellet technique described earlier. Sample 6, with coercivity substantially less than 300 Oe, does not flow properly on a rotating core magnetic brush assembly, in that it is subject to the "freezing" agglomeration process described earlier when run as carrier without toner.

TABLE 5

| Sample Number | Mole % Lithium Ferrite | Mole % $TiO_2$ | Ms emu/g | Mr emu/g | Hc Oe | Dvol microns |
|---|---|---|---|---|---|---|
| 1 | 50 | 0 | 59.1 | 25.4 | 875 | 17.4 |
| 2 | 67 | 0 | 59.7 | 19.8 | 409 | 17.7 |
| 3 | 67 | 0 | 59.7 | 19.5 | 450 | 22.6 |
| 4 | 67 | 0 | 58.8 | 17.9 | 437 | 30.3 |
| 5 | 75 | 0 | 59 | 15.4 | 292 | 22.3 |
| 6 | 85 | 0 | 60.9 | 10.2 | 123 | 21.0 |

TABLE 5-continued

| Sample Number | Mole % Lithium Ferrite | Mole % $TiO_2$ | Ms emu/g | Mr emu/g | Hc Oe | Dvol microns |
|---|---|---|---|---|---|---|
| 7 | 67 | 0.5 | 59.4 | 14.5 | 432 | 22.0 |
| 8 | 67 | 1 | 60.6 | 11.8 | 291 | 22.0 |

Table 5 also describes two inventive strontium-lithium ferrite composite carriers, where titanium dioxide, $TiO_2$, was included as a dopant for the purpose of increasing the conductivity of the carrier powder. Samples 7 and 8 were prepared with 0.5% and 1.0% titanium dioxide added by weight, to a strontium-lithium ferrite composite carrier at 67 mole % lithium ferrite. Resistivity values were obtained using a three-terminal packed powder cell and a QuadTech Model 1920 Precision LCR Meter, with a 0.02 V/mil AC field at a frequency of 1 kHz. Resistivity values of $4.42\times10^7$ and $1.12\times10^7$ ohm*cm were measured for samples 7 and 8, respectively, while the comparison non-doped sample 3 was measured at $1.04\times10^9$ ohm*cm. Rate of development experiments were conducted on a linear breadboard bias voltage toning apparatus operating at a speed of 20 in/sec with a 14 pole rotating core magnet at 1000 rpm at a spacing of 15 mil and 6% Kodak HD toner as sold for use in the NexPress 3900 printer, with 1.25% resin coated carriers based on inventive composite carrier core samples 3, 7 and 8. The rate of SPD toning measured in this manner was increased by a factor of 1.97 and 1.65 for the titanium dioxide doped samples 7 and 8 over that of sample 3 without doping. Increased rate of development has the advantage of enabling printers to run at higher speed. Doping with Ti also has the effect of decreasing the degree of permanent magnetism as seen in Mr and Hc values. Other elements can be used as a dopant to increase conductivity or decrease resistivity, including lanthanum.

Figure 11:
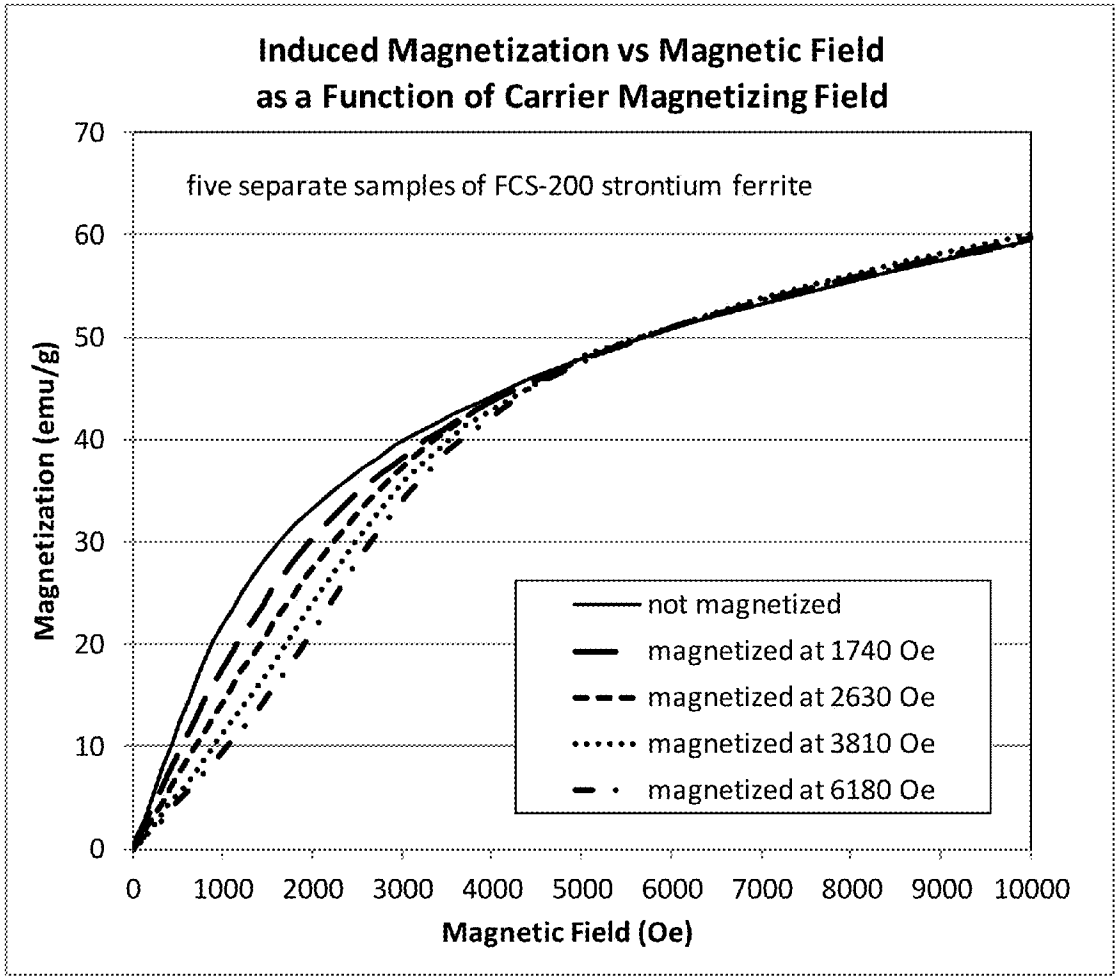
FIG. 11 is a plot of the induced magnetization versus applied magnetic field for several levels of magnetization for a hard magnetic carrier material.

The permanent magnetization of a strontium ferrite carrier alters its response to an applied magnetic field, as seen in FIG. 11. FCS-200 strontium ferrite carrier was tested as received from the supplier in the non-magnetized condition, along with four samples of the same lot of carrier each of which had been subjected to a high magnetic field in order to render the particles permanently magnetic. The magnetization was conducted in an RFL Industries Model 595 Magnetreater at four separate machine settings of 50, 200, 400, and 800, yielding measured fields of 1740, 2630, 3810 and 6180 Oe. The samples were loosely contained in a plastic jar such that they were free to move and chain up in response to the magnetizing field. Prior to preparation of pellets for the VSM measurement they were shaken to randomize the orientation of the north-south axes of the individual particles. At low fields, the slope of the magnetization vs. field response decreases as the magnetizing field that the samples were subjected to increases. At higher fields the magnetization curves coalesce into a common curve, along with the remainder of the hysteresis loops, which are not shown here.

Table 6 summarizes key values taken from the FIG. 11 data, including the magnetization or induced moment at a field of 1000 Oe or G, and the initial susceptibility which are defined to be the slope of the magnetization vs. field relationship at a field of 100 Oe. The magnetization vs. field curves are within experimental error linear up to 500 Oe; the initial susceptibility as defined is the slope of that relationship. The values in Table 6 were interpolated from the data which are shown in graphical form in FIG. 11. The magnetization at 1000 Oe drops monotonically from 21.8 emu/g for the as received non-magnetized sample, to 9.3 emu/g for the sample magnetized at the highest field attainable in the RFL device of about 6200 Oe. The initial susceptibility drops monotonically from 0.0215 to 0.0084 emu/(g*Oe) for the same samples. The developer materials using FCS grade strontium ferrites sold by Eastman Kodak for use in the NexPress printer are magnetized under conditions that lead to an initial susceptibility of approximately 0.01 emu/(g*Oe) and an induced moment of approximately 11 emu/g at an applied field of 1000 Oe. The importance of magnetizing the carrier before use in an electrophotographic development apparatus and process with rotating magnetic core magnets is due to a number of factors; one of which is the desire to reduce the phenomenon of developer pickup on the photoreceptor, as discussed in U.S. Pat. No. 4,473,029. A particular reason is to increase the stability of that development process by reducing the changes in degree of magnetization of the carrier which result from use in the development process due to factors including exposure of the carrier to the magnetic fields of the core magnets, and carrier to carrier contact during the vigorous mixing action of process elements.

TABLE 6

| RFL 595 Dial Setting | RFL 595 Magnetic Field (Oe) | Carrier Magnetization at 1000 Oe (emu/g) | Initial Susceptibility (emu/(g*Oe)) |
|---|---|---|---|
| — | 0 | 21.8 | 0.0215 |
| 50 | 1740 | 17.6 | 0.0171 |
| 200 | 2630 | 14.3 | 0.0124 |
| 400 | 3810 | 11.3 | 0.0102 |
| 800 | 6180 | 9.3 | 0.0084 |

It is believed that the change in the magnetic response of hard magnetic carrier materials to the degree to which they have been magnetized prior to sale and subsequent use in a rotating magnetic core development process is important in the realization of the usefulness of the present invention. The magnetic domain structure in non-magnetized hard magnetic magnetoplumbite phase carrier powders includes multiple anti-parallel domains with magnetization vectors parallel to the crystallographic c axis. An applied low strength magnetic field, such as that produced by a magnetic toner concentration monitor, is able to bend the domain walls of these small volume, small net moment domains, resulting in the observed susceptibility of about 0.02 emu/(g*Oe) measured for non-magnetized strontium ferrite materials. The output signal of the magnetic toner concentration monitor is proportional to that value; this signal drops as toner is mixed in and dilutes the spatial concentration of carrier in the sensing zone of the monitor, thus providing the basis of toner concentration control in the development apparatus and process. If the field a hard magnetic material is subjected to is high enough to increase the size of domains aligned with the field at the expense of those domains oppositely disposed, the result is the development of a retained magnetization, quantifiable as magnetic remanence value on a measuring device such as a VSM. As the domain volume and thus net magnetic moment increase in this manner as the magnetizing field is increased, the domain wall energy required to stabilize the magnetic structure increases, and in consequence, the response of the moment to an applied field, i.e., the susceptibility, decreases. At higher fields, the crystallite grains become consumed as single domains, and the susceptibility of a randomly oriented hard magnetic strontium ferrite carrier powder collection levels off, in the range of about 0.008 emu/(g*Oe). At this point ferromagnetic saturation has occurred for those domains appropriately aligned to the applied field; this is the reason the curves coalesce at higher fields in FIG. 11. The sensitivity of the magnetic toner concentration monitor is thus reduced after the magnetization process. The present invention provides relief to this constraint in that the soft magnetic material portion of the SLF composite particle has a higher initial susceptibility, and thus raises the sensitivity of the toner concentration monitor while permitting for the hard magnetic material portion to be magnetized appropriately. The initial susceptibility for the sample discussed earlier of pure lithium ferrite was measured to be 0.071 emu/(g*Oe).

Figure 12:
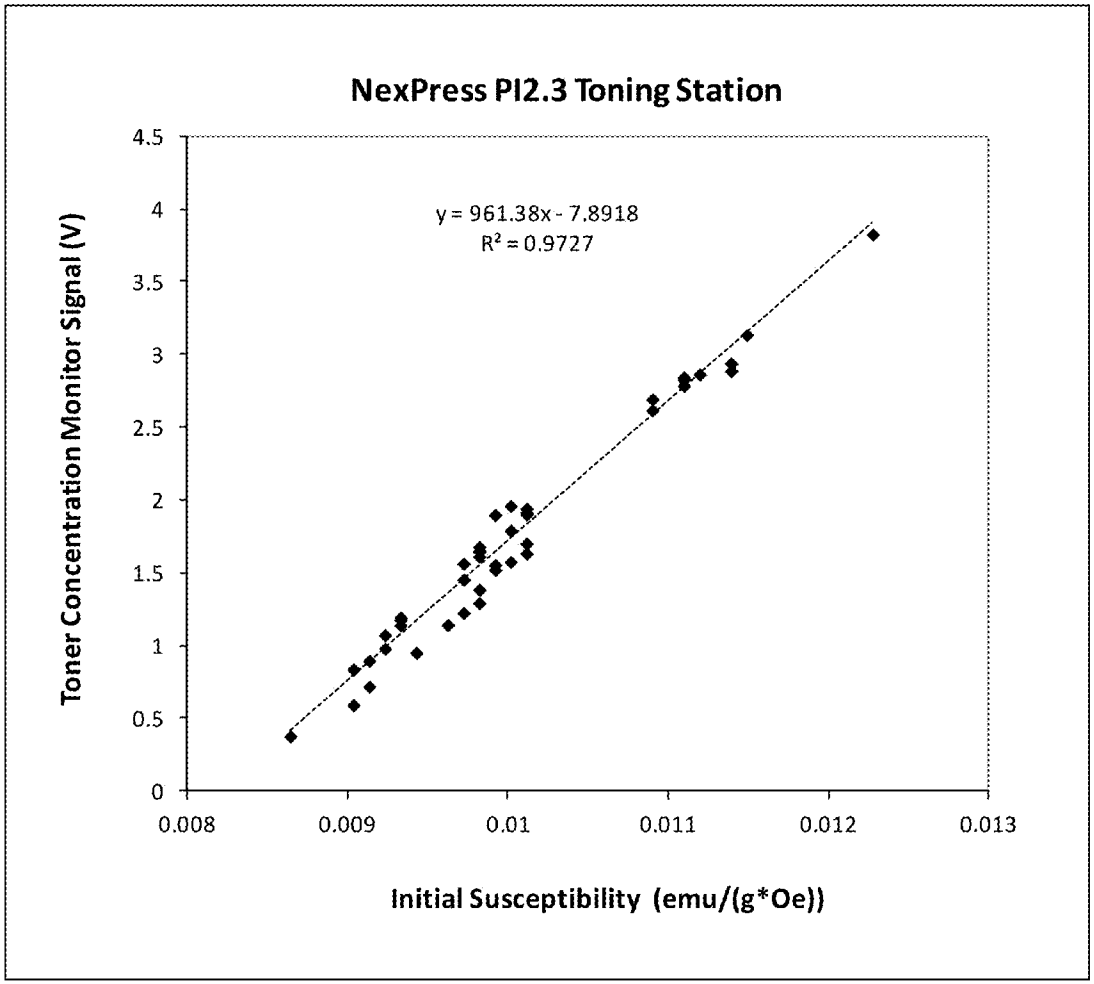
FIG. 12 is a plot of the toner concentration monitor signal versus the initial susceptibility for a hard magnetic carrier material.
Figure 13:
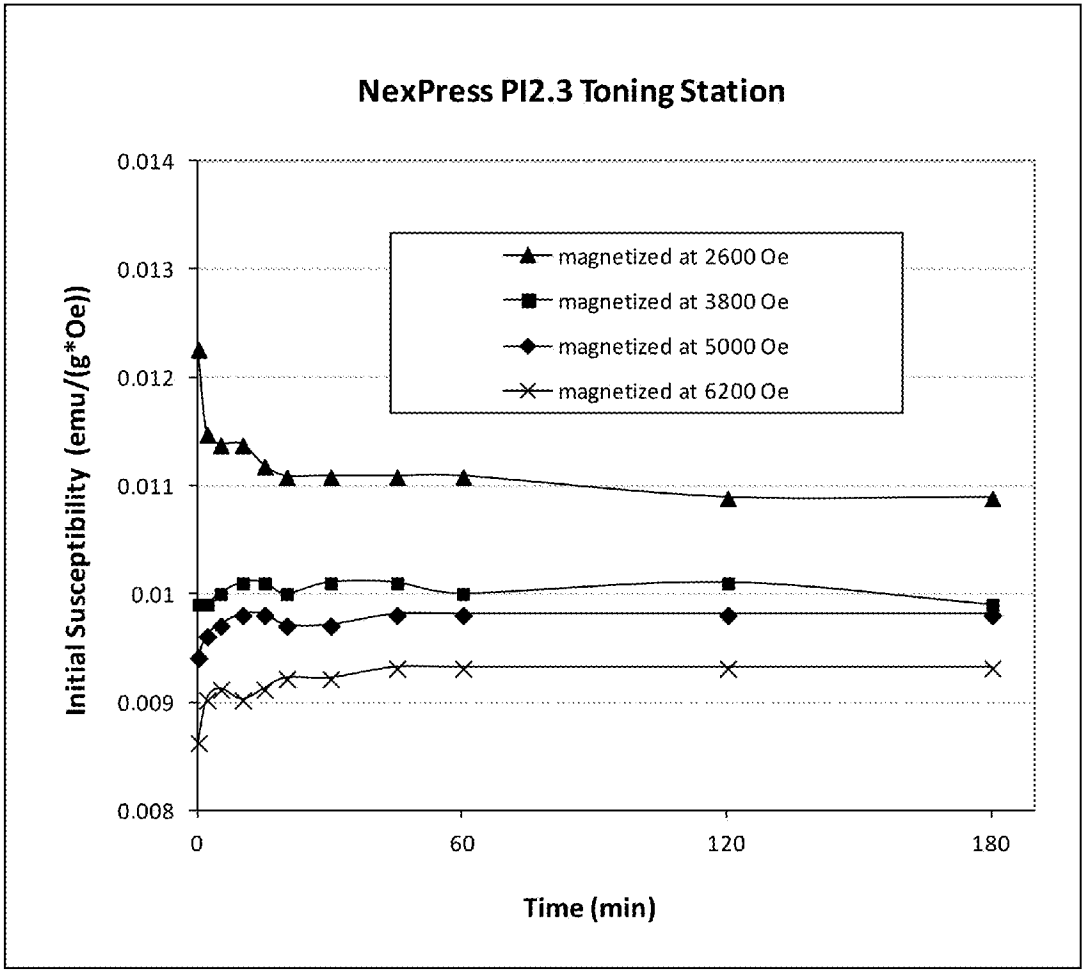
FIG. 13 is a plot of the initial susceptibility versus running time in a NexPress toning station for a hard magnetic material at various magnetization levels.

FIG. 12 illustrates the dependence of the toner concentration monitor signal on the degree of magnetization, as quantified by VSM measurements of initial susceptibility; the values are linearly correlated. These data were produced on a Kodak NexPress toning station running on a bench top outside of the printer. Four separate developers at 6% by weight TC (toner concentration) were separately magnetized at a series of fields spanning approximately 2600 to 6200 Oe; samples were collected over a period of three hours for VSM measurements of initial susceptibility while recording the toner concentration monitor signal at each time. The 3800 Oe sample was magnetized at a setting of 1100V on a production scale Model 8155 Magnetizer built by Magnetic Instrumentation, Inc.; the magnetic field is an estimate. The other three samples were magnetized on the pilot scale RFL Industries Model 595 Magnetreater discussed previously. These susceptibility measurements were taken as the slope of magnetization vs. field between 50 and 100 Oe. The data for the four tests are combined on the plot. FIG. 13 shows the individual sample results for initial susceptibility as a function of run time. It is seen that the least magnetized sample (2600 Oe) drops in susceptibility with time of running in the toning station; the degree of magnetization is thus increasing with time. It is believed that this is due to the continuous exposure of the developer material to the rotating magnetic core of the development roller. The most magnetized sample (6200 Oe) is seen to increase in susceptibility with time of running in the toning station; thus it is becoming de-magnetized relative to where it started. This can be due to the vigorous action of the mixing elements in the toning station continuously forcing like magnetic poles of neighboring particles into intimate contact with each other such that de-magnetizing can occur. An increase in susceptibility has been observed when magnetized hard magnetic carriers or developers are mixed in a variety of types of equipment, the rate of which is in general proportional to the intensity of the mixing process. It is thus believed that there are competing magnetizing and de-magnetizing processes occurring when a hard magnetic developer is exercised in toning process hardware utilizing a rotating magnetic core development roller (which can further magnetize a material) and a mixing section (which can de-magnetize the developer), the primary purpose of which is to mix toner with developer. With time, the developer will reach an equilibrium level of magnetization. The stability of the development process is thus increased when the degree of initial magnetization of the developer in the factory is selected such that it results in the least change of the initial susceptibility of the carrier material over time of running in the development process. A lightly magnetized developer that increases in magnetization with time with the associated decrease in susceptibility will result in a decrease in toner concentration with time as driven by the signal from a magnetic toner concentration monitor because the control algorithm will call for less toner replenishment in order to keep the signal constant over time compared to a developer that was constant in degree of magnetization. A highly magnetized developer that decreases in magnetization and thus increases in susceptibility with time of running will instead increase in toner concentration compared to a developer that was constant in degree of magnetization. The extra toner is needed to dilute the carrier with increased susceptibility such that the concentration monitor signal is kept constant. Toner concentration has a large effect on the critical gain factor in the electrophotographic imaging process, the output density for a given electrostatic latent image. Thus stable developer magnetization and the resulting stable toner concentration are needed. The magnitude of the magnetizing field for the hard magnetic strontium ferrite carriers sold in developers for use in Eastman Kodak's electrophotographic copiers and printers utilizing SPD two-component development has been selected with regard to this optimization of process stability. The strontium ferrite hard component of the strontium-lithium ferrite hard/soft magnetic composite carrier materials of the present invention has been observed to respond in the same manner as carrier particles comprising pure strontium ferrite. It is thus necessary to magnetize the SLF composite in order to both reduce variations in toner concentration and reduce developer pick-up.

Figure 14:
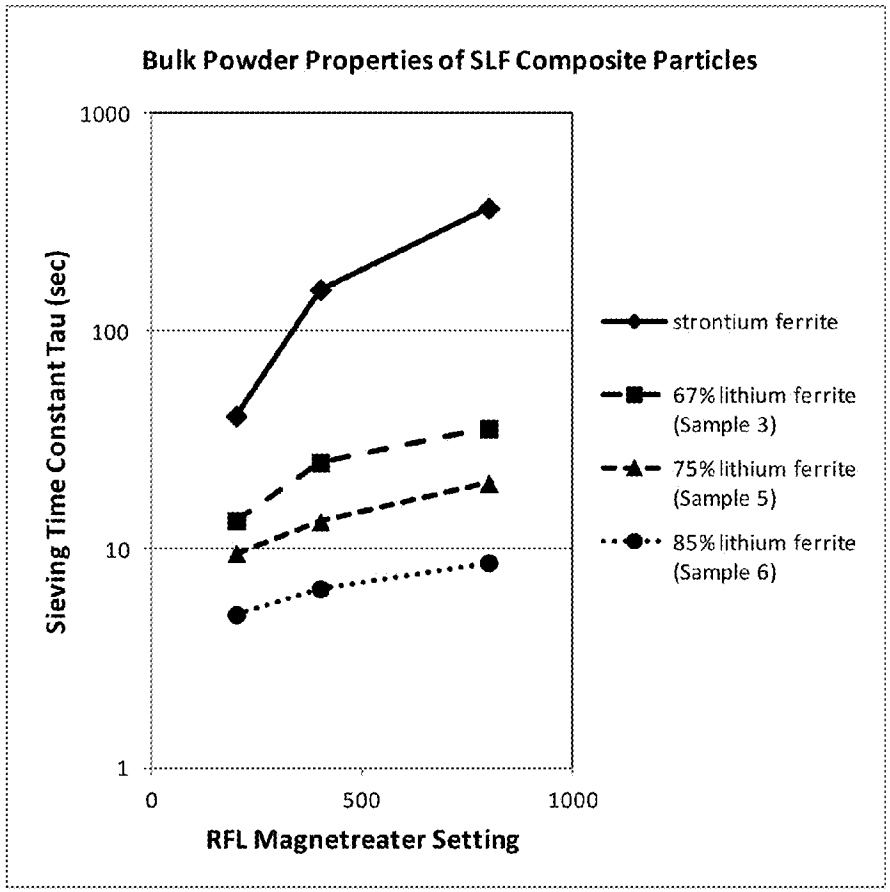
FIG. 14 is a plot of the sieving time constant versus the RFL Magnetreater setting of several carrier particle compositions.

The addition of the soft magnetic portion to the hard magnetic portion of the composite carrier increases the free flow ability of the bulk developer powder. This enhances the ability to quickly mix in replenisher toner with developer in the mixer section of a rotating core toning apparatus, as exemplified in FIG. 4. This improvement in the developer bulk powder flow ability is illustrated by a rate of sieving measurement. Fifty grams of carrier powder was introduced onto a 50 mesh, 8 inch diameter sieve screen by spreading it uniformly in an area constrained by a 4.5 inch diameter plastic ring. The ring was removed, and the sieve was placed on a pan to collect and weigh carrier material that had passed through as a function of sieve shaking time. The sieve and pan assembly was covered and placed on a "Portable Sieve Shaker Model RX-24V" manufactured by W. S. Tyler Combustion Engineering Inc. The weight of the collection pan was taken at a selected series of shaking times. The weight percentage of material passed at 7, 15, 30, 60, 120 and 240 sec of cumulative shaking time t was fit to an exponential equation, % Sieved(t)=100−100*EXP(−t/Tau). The best fit value of Tau was obtained by minimizing the sum of squares of the residuals between the data and the equation using the Solver function of Microsoft Excel software. The sieving time constant Tau is high for powders with poor bulk flow ability, and low for powders with good bulk flow. FIG. 14 is a plot of the sieving time constant for a series of magnetized strontium-lithium ferrite composite materials taken from Table 5, where the mole % of lithium ferrite was varied from 67% to 85%, as a function of the degree of magnetization on the RFL Industries Model 595 Magnetreater described earlier. Settings of 200, 400 and 800 were used, corresponding to magnetizing fields of approximately 2600, 3800 and 6200 Oe. Comparison data are included for a 1.6% by weight resin coated, 17 micron diameter hard magnetic strontium ferrite carrier sold for use in the NexPress 3900 printer manufactured by Eastman Kodak. The free flow ability, as quantified by the sieving time constant Tau, is made worse the higher the degree of magnetization of the carrier, but at a desirably lower slope the higher is the lithium ferrite soft magnetic component of the SLF composite carrier. The free flow ability, as quantified by the sieving time constant Tau, versus that of the magnetized strontium ferrite powder, is improved by a factor of over 6 for the 67 mole % lithium ferrite composite carrier, and by over a factor of 23 for the 85 mole % lithium ferrite composite carrier, at the standard magnetizer setting of 400 (3800 Oe field).

The phenomenon of the agglomeration of soft magnetic carrier materials into non-moving chains on a magnetic brush with a rotating magnetic core was described previously. This "freezing" property can still occur in the inventive hard/soft SLF carrier particles at high concentrations of the soft component. For example, it has been found that freezing begins to occur at approximately 85 mole % lithium ferrite soft component in SLF composite carrier materials when running on a magnetic brush operating in the range of 800 to 3000 core rpm with 14 magnetic poles in the core magnet assembly. A particularly useful range of added lithium ferrite soft component to a strontium ferrite-lithium composite carrier particle is approximately 20% to 85% molar concentration. As the lithium ferrite concentration is lowered, the degree of the reduction of toning spacing sensitivity is reduced.

Figure 10:
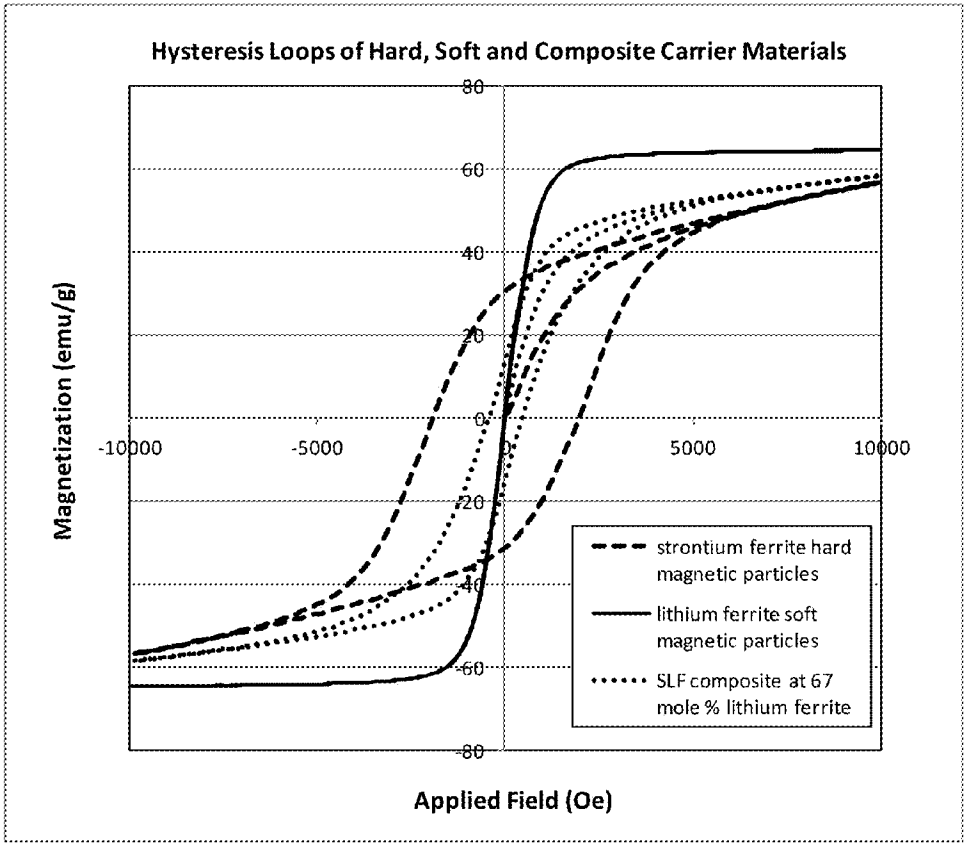
FIG. 10 is a plot of magnetic hysteresis loops for exemplary magnetically hard, magnetically soft, and composite carrier materials.
Figure 15:
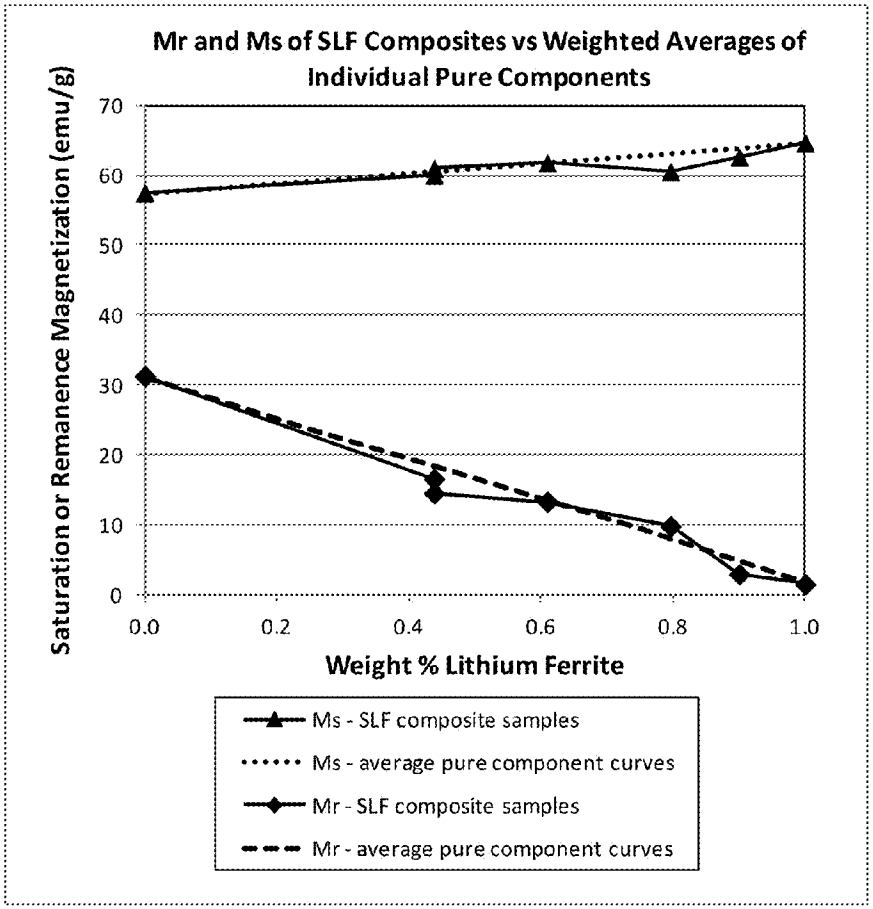
FIG. 15 is a plot of the saturation magnetization or the remanence magnetization in emu/g versus the weight percent of lithium ferrite in strontium lithium ferrite composite materials compared to the weighted average of pure lithium ferrite and strontium ferrite.

It is believed that the use of soft magnetic lithium ferrite in a composite with hard magnetic strontium ferrite, rather than other typical soft ferrites used for conventional two-component development such as magnetite ($Fe_3O_4$), copper-zinc ferrite and manganese-magnesium-strontium ferrite, uniquely enables hard/soft composite materials useful for SPD toning with a rotating magnet based development apparatus. These other soft magnetic materials require inert or reducing firing conditions to increase magnetic properties; they are typically fired in a nitrogen atmosphere. Iron is present as both $Fe^{+2}$ and $Fe^{+3}$ in such soft ferrites. Lithium ferrite $LiFe_5O_8$ and strontium ferrite $SrFe_{12}O_{19}$ are necessarily fired in air to increase magnetic their properties; iron is present in only the $Fe^{+3}$ valence state in these materials. When strontium ferrite is fired in nitrogen its full magnetic properties are not realized; we attribute this to the formation of either nitrides or carbides. Another advantage of lithium ferrite is that the lithium cation does not incorporate significantly into the strontium ferrite lattice, thus leaving that compound unaltered. The x-ray diffraction results just described, along with analysis of the measured magnetic properties of the strontium-lithium composite particles, confirm that these are two-phase composites of strontium ferrite and lithium ferrite. FIG. 10 presents magnetic hysteresis loop data for strontium ferrite (FCS-200 from Powdertech), lithium ferrite (100% lithium ferrite sample from Table 4), and an SLF strontium-lithium ferrite composite with 67 mole % lithium ferrite (Table 5 sample 3 from Powdertech). These samples were not subjected to an initial magnetizing field. The curve for the composite carrier can be essentially duplicated by a weighted average of the magnetization data in emu/g of the separate strontium ferrite and lithium ferrite curves over each point of applied field. Such averaging was conducted for a series of composite materials prepared by the same techniques as described for the samples of Tables 3 and 4. FIG. 15 shows the results of this analysis in terms of the extracted values for saturation magnetization Ms and remanence magnetization Mr from the weighted average hysteresis loops as a function of composition of the composite. The calculated curves closely match the measured values for sample strontium-lithium ferrite samples. The conclusion is thus reached that the magnetic properties of the strontium-lithium composite carriers are those that would be realized if the individual components within the composite had the identical magnetic properties as separately prepared strontium and lithium ferrites. There appears to have been no chemical interaction between the hard and soft magnetic components during their firing. The induced moment of the composite at a field of 1000 Oe is also predicted by the weighted averaging of the pure component hysteresis loop magnetization values at 1000 Oe. For a strontium ferrite magnetized at the 3800 Oe magnetic field condition used to manufacture developer for the NexPress the value is about 11 emu/g at 1000 Oe, for pure lithium ferrite the value is 52.6 emu/g, for a 67% mole % lithium ferrite composite the value is 27.1 emu/g when magnetized at a field of 3800 Oe. The 67 mole % lithium ferrite corresponds to 44.2% by weight; the weighted average of the individual components is thus 44.2% of 52.6 plus 55.8% of 11, or 29.4 emu/g. The measured value of 27.1 emu/g is in close agreement. The hard magnetic component in the strontium-lithium ferrite behaves magnetically as pure strontium ferrite hard magnetic carrier, and thus has an induced moment of less than 20 emu/g when properly magnetized as discussed previously.

Another illustration of the unique and advantageous properties of hard/soft composite carrier compositions based on strontium ferrite and lithium ferrite can be seen in flow properties on a rotating core magnetic SPD development apparatus, in comparison with 100% strontium ferrite carrier and a hard/soft strontium/cobalt ferrite composite carrier as disclosed in U.S. Pat. No. 5,106,714. The strontium ferrite carrier was based on FCS-200 from Powdertech. The SLF composite carrier was that of Table 5, sample 3, with 67 mole % lithium ferrite. The strontium/cobalt composite was made by Powdertech with 18.66 lbs of strontium carbonate, 76.96 lbs of cobalt carbonate, 7.91 lbs of lanthanum carbonate and 264.44 lbs of ferric oxide. The lanthanum was added as a dopant to increase conductivity. Table 7 presents carrier flow rate data for these three materials taken at a DMAD nap density of 0.3 g/in$^2$ for two brush conditions of 800 rpm core, 0 rpm shell and 800 rpm core, 90 rpm shell with a 14 pole magnetic core and a 2 inch diameter shell. The flow rate is measured with a pivoting cup device that skives moving material from the magnetic brush with a two inch wide cup for one half of a second; the weight of the material removed is thus the flow rate in grams/inch/second. It is seen that the flow rates are similar for the strontium ferrite and SLF strontium-lithium ferrite composite, while that of the strontium-cobalt composite is much lower. Such lower flow values result in problems on an SPD printer such as the NexPress, including slow rates of development, and edge washout effects due to the large mismatch in the transport speed of the developer relative to that of the photoreceptor. The strontium-cobalt composite, as disclosed in U.S. Pat. No. 5,106,714, was fired in air as are the inventive strontium-lithium ferrites. Magnetic VSM measurements reveal that it has only 59% of the initial susceptibility of strontium ferrite and 16% of that of strontium-lithium ferrite; the induced moment at 1000 Oe is similarly low, and is believed to be the cause of the low flow rate. It is believed that the inability of the lithium cation to become incorporated in the strontium ferrite crystal lattice is largely responsible for the unique properties and usefulness of the strontium-lithium ferrite composition.

TABLE 7

| Sample | Core rpm | Shell rpm | Flow Rate g/inch/sec |
|---|---|---|---|
| strontium ferrite | 800 | 0 | 1.20 |
| | 800 | 90 | 2.75 |
| strontium-lithium ferrite | 800 | 0 | 1.31 |
| | 800 | 90 | 2.54 |
| strontium-cobalt ferrite | 800 | 0 | 0.49 |
| | 800 | 90 | 1.52 |

The present invention is inclusive of combinations of the embodiments described herein. References to "a particular embodiment" and the like refer to features that are present in at least one embodiment of the invention. Separate references to "an embodiment" or "particular embodiments" or the like do not necessarily refer to the same embodiment or embodiments; however, such embodiments are not mutually exclusive, unless so indicated or as are readily apparent to one of skill in the art. The use of singular or plural in referring to the "method" or "methods" and the like is not limiting. The word "or" is used in this disclosure in a non-exclusive sense, unless otherwise explicitly noted.

The invention has been described in detail with particular reference to certain preferred embodiments thereof, but it will be understood that variations, combinations, and modifications can be effected by a person of ordinary skill in the art within the spirit and scope of the invention.

PARTS LIST

31, 32, 33, 34, 35 printing module
38 print image
39 fused image
40 supply unit
42, 42A, 42B receiver
50 transfer subsystem
60 fuser
62 fusing roller
64 pressure roller
66 fusing nip
68 release fluid application substation
69 output tray
70 finisher
81 transport web
86 cleaning station
99 logic and control unit (LCU)
100 printer
102, 103 roller
104 transmission densitometer array
104R red transmission densitometer
104G green transmission densitometer
104B blue transmission densitometer
104V visually weighted transmission densitometer
105 power supply
106 light sensor
109 interframe area
110 light beam

PARTS LIST CONT'D

111, 121, 131, 141, 151 imaging member
112, 122, 132, 142, 152 transfer member
113, 123, 133, 143, 153 transfer backup member
114 density patches
120 control unit
124, 125 corona tack-down chargers
144 gudgeon
145 shim
201 transfer nip
202 second transfer nip
206 photoreceptor
210 charging subsystem
211 meter
212 meter
213 grid
216 surface
220 exposure subsystem
224 magnetic poles
225 development subsystem
226 toning shell
227 magnetic core
228 toning zone spacing
229 metering skive
230 developer sump
231 metering skive spacing
234 developer
235 feed roller
236 toning zone
237 mixers
238 replenishment tube

PARTS LIST CONT'D

239 toner monitor
240 power source
ITM1-ITM5 intermediate transfer member
PC1-PC5 imaging member
$R_n$-$R_{(n-6)}$ receiver
TR1-TR5 transfer backup member

The invention claimed is:

1. A method for reducing toning spacing sensitivity in an electrophotographic process comprising:
(a) providing a rotating magnetic member within a conductive non-magnetic development sleeve;
(b) providing a developer to the non-magnetic development sleeve for use with the rotating magnetic member including:
(i) composite magnetic particles comprising strontium ferrite and lithium ferrite phases, wherein a mole percentage of lithium ferrite in the composite magnetic particles of the developer is in a range from 20% to 85% by weight and
(ii) toner particles; and
(c) moving a charged receiving medium into a toner transfer relationship with the developer on the non-magnetic development sleeve so as to provide a developed image on the receiving medium with reduced toning spacing sensitivity.

2. The method of claim 1 wherein a coercivity of the composite magnetic particles is greater than 200 oersted.

3. The method of claim 1 wherein the non-magnetic sleeve is rotated.

4. The method of claim 1 wherein the non-magnetic sleeve is stationary.

5. The method of claim 1 further including treating the composite magnetic particles in a magnetic field to render a degree of permanent magnetism.

6. The method of claim 1 wherein a toner concentration of the developer is in a range from 3% to 25% by weight.

7. A method for reducing toning spacing sensitivity in an electrophotographic process comprising:
(a) providing a rotating magnetic member within a conductive non-magnetic development sleeve;
(b) providing a developer to the non-magnetic development sleeve for use with the rotating magnetic member including:
(i) hard magnetic particles with a coercivity of greater than 300 oersted and an induced moment of less than 20 emu per gram at an applied field of 1000 oersted;
(ii) composite magnetic particles comprising strontium ferrite and lithium ferrite phases; and
(iii) toner particles; and
(c) moving a charged receiving medium into a toner transfer relationship with the developer on the non-magnetic development sleeve so as to provide a developed image on the receiving medium with reduced toning spacing sensitivity.

8. The method of claim 7 wherein the non-magnetic sleeve is rotated.

9. The method of claim 7 wherein the non-magnetic sleeve is stationary.

10. The method of claim 7 further including treating the hard magnetic particles in a magnetic field to lower the induced moment to less than 20 emu per gram at an applied field of 1000 oersted before providing the developer to the non-magnetic development sleeve.

11. The method of claim 7 further including treating the composite magnetic particles in a magnetic field to render a degree of permanent magnetism.

12. The method of claim 7 wherein a toner concentration of the developer is in a range from 3% to 25% by weight.

13. The method of claim 7 wherein a percentage of composite magnetic particles in a carrier component of the developer is in a range from 10% to 90% by weight.

14. The method of claim 7 wherein the hard magnetic particles comprise strontium ferrite.

15. The method of claim 7 wherein a mole percentage of lithium ferrite in the composite magnetic particles of the developer is in a range from 20% to 95% by weight.

* * * * *